US006952544B2

(12) United States Patent
Kikuchi et al.

(10) Patent No.: US 6,952,544 B2
(45) Date of Patent: Oct. 4, 2005

(54) METHOD OF REPRODUCING PROCESS CARTRIDGE OR DEVELOPING APPARATUS

(75) Inventors: Ken Kikuchi, Shizuoka (JP); Toru Oguma, Shizuoka (JP); Akiyoshi Yokoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 56 days.

(21) Appl. No.: 10/670,246

(22) Filed: Sep. 26, 2003

(65) Prior Publication Data

US 2004/0131382 A1 Jul. 8, 2004

(30) Foreign Application Priority Data

Sep. 30, 2002 (JP) ..... 2002-287307
Sep. 16, 2003 (JP) ..... 2003-323555

(51) Int. Cl.[7] ..... G03G 15/00
(52) U.S. Cl. ..... 399/109
(58) Field of Search ..... 399/106, 109, 399/111, 119, 120, 258, 262, 263

(56) References Cited

U.S. PATENT DOCUMENTS 5,729,795 A * 3/1998 Kavolius et al. ..... 399/109
5,937,238 A * 8/1999 Tremblay et al. ..... 399/109
5,940,658 A 8/1999 Yokoi et al. ..... 399/119
6,097,909 A 8/2000 Watanabe et al. ..... 399/111
6,141,513 A * 10/2000 Nishiuwatoko et al. ..... 399/109
6,223,010 B1 * 4/2001 Araki ..... 399/109
6,240,605 B1 * 6/2001 Stevens et al. ..... 399/106 X
6,253,036 B1 6/2001 Karakama et al. ..... 399/27
6,266,500 B1 7/2001 Numagami et al. ..... 399/104
6,272,299 B1 8/2001 Numagami et al. ..... 399/111
6,377,759 B1 4/2002 Abe et al. ..... 399/27
6,512,895 B2 1/2003 Sakurai et al. ..... 399/13
6,577,830 B1 * 6/2003 Wazana et al. ..... 399/109
6,587,650 B2 7/2003 Yokoi et al. ..... 399/27
2001/0041080 A1 * 11/2001 Higeta et al. ..... 399/109 X

FOREIGN PATENT DOCUMENTS

JP 8-314359 11/1996

* cited by examiner

*Primary Examiner*—Sandra L. Brase
(74) *Attorney, Agent, or Firm*—Fitzpatrick, Cella, Harper & Scinto

(57) ABSTRACT

A method of reproducing a process cartridge or a developing apparatus includes the step of removing a supporting member from a developing frame body, the step of separating a developer container and the developing frame body from each other in a joint portion wherein the developer container and the developing frame body are joined together, the sticking step of sticking a seal member on an opening portion for supplying a developer in the separated developer container to close the opening portion, the developer refilling step of refilling the developer container with the developer, the step of recoupling the developer container and the developing frame body together thereafter, and the step of reattaching the supporting member onto one of the developer container and the developing frame body. As a result, the recycling of the developing apparatus or the process cartridge can be effected easily.

20 Claims, 27 Drawing Sheets

METHOD OF REPRODUCING PROCESS CARTRIDGE OR DEVELOPING APPARATUS

BACKGROUND OF THE INVENTION

1. Field of the Invention

This invention relates to a method of reproducing a process cartridge detachably attachable to an electrophotographic image forming apparatus and a method of reproducing a developing apparatus.

2. Description of Related Art

In an image forming apparatus using an electrophotographic image forming process, there has heretofore been adopted a cartridge system in which developing means and a developer containing portion are integrally made into a cartridge or an electrophotographic photosensitive member and process means (including the developing means and the developer containing portion) for acting on the electrophotographic photosensitive member are integrally made into a cartridge, which is made detachably attachable to an electrophotographic image forming apparatus main body. The electrophotographic photosensitive member and the process means for acting on the electrophotographic photosensitive member, which are integrally made into a cartridge, are usually called a process cartridge.

According to this cartridge system, the maintenance of the image forming apparatus can be effected by a user himself without resort to a serviceman and therefore, operability can be markedly improved. So, this cartridge system is widely used in electrophotographic image forming apparatuses.

Such a cartridge (a developing apparatus made into a cartridge, or a process cartridge) serves to form an image on a recording medium by the use of a toner (developer). So, the toner is consumed as image forming is effected. The cartridge loses a commercial value as a cartridge when the toner has been consumed to such an extent that it becomes impossible to form an image of satisfactory quality for a user who purchased the cartridge.

Heretofore there has been desired the realization of a simple cartridge reproducing method which can again commercialize a cartridge which has lost a commercial value with the toner therein consumed.

The present invention is applied to a method of reproducing a process cartridge made detachably attachable to an electrophotographic image forming apparatus and a method of reproducing a developing apparatus.

Here, the electrophotographic image forming apparatus is an apparatus for forming an image on a recording medium by the use of the electrophotographic image forming process. Examples of the electrophotographic image forming apparatus include an electrophotographic copying machine, electrophotographic printers (e.g. a laser printer, an LED printer, etc.); a facsimile apparatus, a word processor, etc.

Also, the process cartridge refers to at least developing means and an electrophotographic photosensitive member integrally made into a cartridge, which is made detachably attachable to an electrophotographic image forming apparatus main body.

SUMMARY OF THE INVENTION

It is an object of the present invention to provide a method of reproducing a developing apparatus and a process cartridge which can be simply reproduced.

It is another object of the present invention to provide a method of reproducing a developing apparatus and a process cartridge which enable the attachment of a supporting member for supporting a developing member to be simply effected.

It is another object of the present invention to provide a method of reproducing a developing apparatus and a process cartridge which enable the mounting of a developing member to be effected simply and reliably.

It is another object of the present invention to provide a method of reproducing a developing apparatus and a process cartridge which enable a supporting member to be simply attached by a coupling member instead of the mounting portion of the supporting member removed when a developer container and a developing frame body are separated from each other, and a process cartridge.

It is another object of the present invention to provide a method of reproducing a developing apparatus detachably attachable to an electrophotographic image forming apparatus main body for developing a latent image formed on an electrophotographic photosensitive member, the developing apparatus having a developing member for developing the latent image formed on the electrophotographic photosensitive member, a developer container having a developer containing part containing therein a developer to be used by the developing member, and provided with a developer supplying opening for supplying the developer contained in the developer containing part to the developing member, a supporting member provided on a lengthwise end portion of the developing apparatus for supporting the developing member, and a developing frame body provided with a developer passing opening for passing therethrough the developer supplied from the developer supplying opening, and having a joint portion to be joined to the developer container, and a mounting portion for mounting the supporting member, the method comprising:

a supporting member removing step of removing the supporting member from the developing frame body;

a developing frame body separating step of separating the developer container and the developing frame body from each other at the joint portion, and at which at least a portion of the mounting portion is removed when the developer container and the developing frame body are separated from each other;

a sticking step of sticking a seal member for closing the developer supplying opening provided in the developer container separated at the developing frame body separating step;

a developer refilling step of refilling the developer containing part provided in the developer container separated at the developing frame body separating step with the developer;

a developing frame body coupling step of coupling the developer container and the developing frame body separated at the developing frame body separating step together after the sticking step; and a supporting member attaching step of attaching the supporting member removed at the removing step onto at least one of the developer container and the developing frame body by the use of a coupling member.

It is another object of the present invention to provide a method of reproducing a process cartridge detachably attachable to an electrophotographic image forming apparatus main body, the process cartridge having a developing member for developing a latent image formed on an electrophotographic photosensitive member, the electrophotographic photosensitive member, a developer container having a developer containing part containing therein a developer to be used by the developing member, and provided with a developer supplying opening for supplying the developer contained in the developer containing part to the developing member, a supporting member provided on a lengthwise end portion of the process cartridge for supporting the developing member, and a developing frame body provided with a developer passing opening for passing therethrough the developer supplied from the developer supplying opening, and having a joint portion to be joined to the developer container, and a mounting portion for mounting the supporting member, the method comprising:

a supporting member removing step of removing the supporting member from the developing frame member;

a developing frame body separating step of separating the developer container and the developing frame body from each other at the joint portion, and at which at least a portion of the mounting portion is removed when the developer container and the developing frame body are separated from each other;

a sticking step of sticking a seal member for closing the developer supplying opening provided in the developer container separated at the developing frame body separating step;

a developer refilling step of refilling the developer containing part provided in the developer container separated at the developing frame body separating step with the developer;

a developing frame body coupling step of coupling the developer container and the developing frame body separated at the developing frame body separating step together after the sticking step; and a supporting member attaching step of attaching the supporting member removed at the removing step onto at least one of the developer container and the developing frame body by the use of a coupling member after the developing frame body coupling step.

DESCRIPTION OF THE PREFERRED EMBODIMENTS

Some preferred embodiments of the present invention will hereinafter be described in detail by way of example with reference to the drawings. However, the dimensions, materials, shapes, relative disposition, etc. of constituent parts described in these embodiments are not intended to restrict the scope of the present invention thereto.

A description will hereinafter be provided of an embodiment of the present invention regarding a method of reproducing a process cartridge. Here, the process cartridge includes developing means and a developer containing portion. Accordingly, an electrophotographic photosensitive member, etc., further added to a developing apparatus made into a cartridge can be said to be a process cartridge. Accordingly, the description of an embodiment of the present invention regarding the method of reproducing a process cartridge is also the description of an embodiment of the present invention regarding a method of reproducing a developing apparatus.

[Electrophotographic Image Forming Apparatus A and Process Cartridge B]

Figure 1:
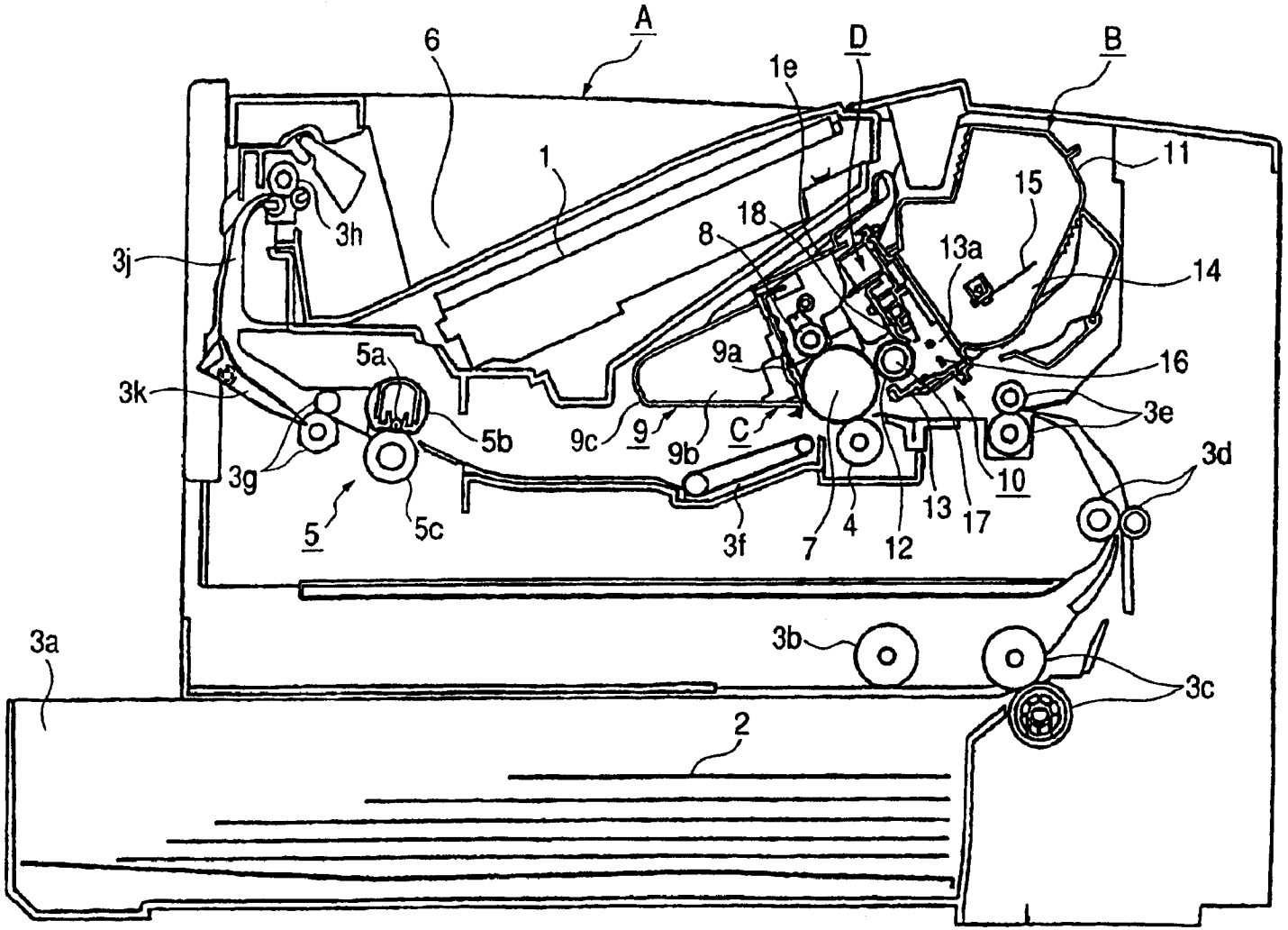
FIG. 1 is a typical cross-sectional view of an electrophotographic image forming apparatus according to an embodiment of the present invention.
Figure 2:
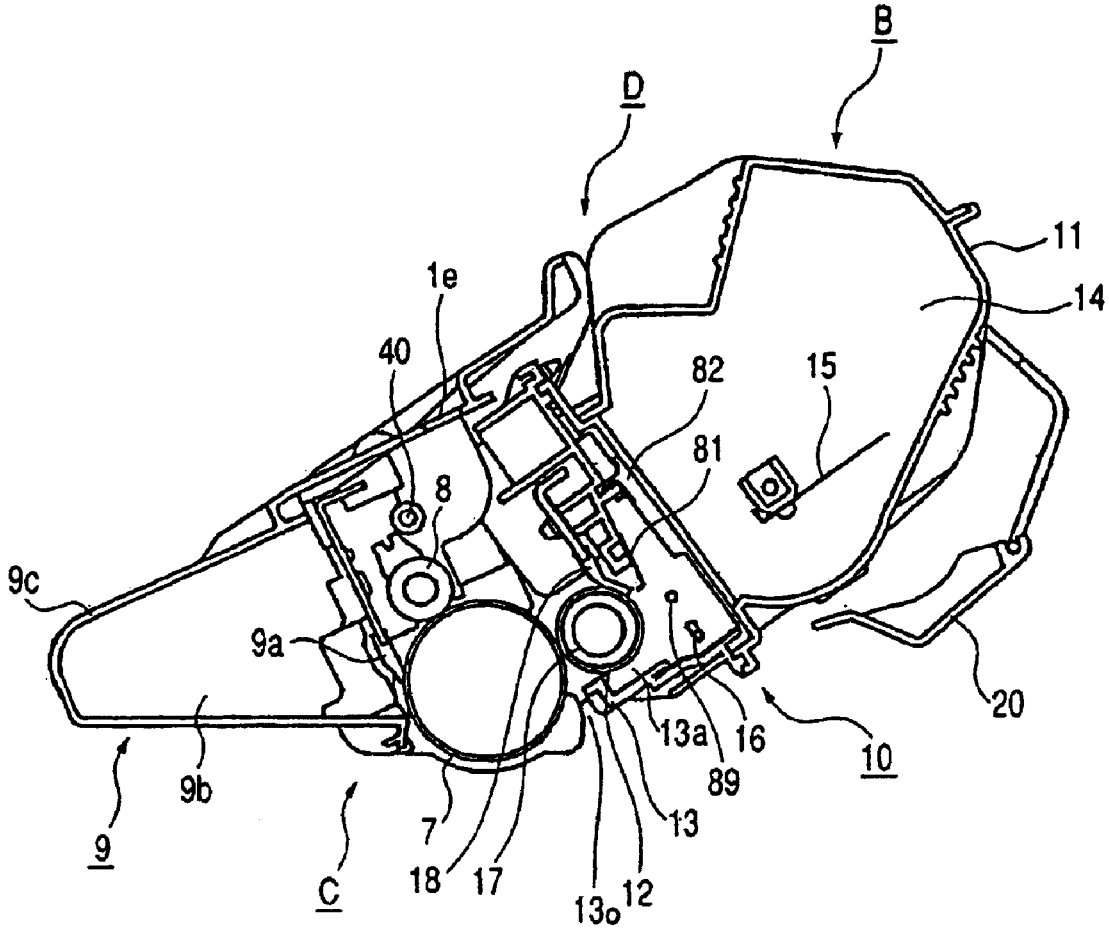
FIG. 2 is a typical cross-sectional view of a process cartridge according to an embodiment of the present invention.

Reference is first made to FIGS. 1 and 2, in particular, to describe an electrophotographic image forming apparatus according to an embodiment of the present invention. FIG. 1 is a typical cross-sectional view of the electrophotographic image forming apparatus according to the embodiment of the present invention. FIG. 2 is a typical cross-sectional view of a process cartridge according to an embodiment of the present invention.

The electrophotographic image forming apparatus A according to the present embodiment serves to form an image on a recording medium (such as recording paper, an OHP sheet or cloth) 2 by an electrophotographic image forming process.

The electrophotographic image forming process will be described here.

In this process, a toner image is formed on a drum-shaped electrophotographic photosensitive member (hereinafter referred to as the photosensitive drum). More particularly, charging is effected on the photosensitive drum 7 by charging means 8 to thereby make uniform the potential of the surface of the drum. Then, a laser beam conforming to image information is applied from optical means 1 to the photosensitive drum 7 to thereby form a latent image conforming to the image information on the photosensitive drum 7. This latent image is developed with a toner, which is a developer, by developing means 10 to thereby form a toner image.

On the other hand, in synchronism with the formation of this toner image, the recording medium 2 set on a sheet feeding cassette 3*a* is reverse-transported by a pickup roller 3*b* and pairs of transporting rollers 3*c,* 3*d* and 3*e.*

Then, the toner image formed on the photosensitive drum 7 in the process cartridge B is transferred to the recording medium 2 by a voltage being applied to a transferring roller 4 functioning as transferring means. Thereafter, the recording medium 2 to which the toner image has been transferred is transported to fixing means 5 by a transport guide 3*f*. This fixing means 5 has a drive roller 5*c* and a fixing roller 5*b* containing a heater 5*a* therein. By this fixing means 5, heat and pressure are applied to the recording medium 2 passing therethrough to thereby fix the transferred toner image.

The recording medium 2 is then discharged to a discharging tray 6 via a reverse transport path 3*j* by the transporting forces of discharging rollers 3*g* and 3*h*. The discharging tray 6 is provided on the upper surface of the image forming apparatus A. A rockable flapper 3*k* can be operated to thereby discharge the recording medium 2 also without the intermediary of the reverse transport path 3*j*.

In the present embodiment, transporting means for transporting the sheet has the pickup roller 3*b,* the pairs of transporting rollers 3*c,* 3*d,* 3*e,* the transport guide 3*f* and the discharging rollers 3*g,* 3*h*.

The cartridge B will now be described with reference to FIGS. 1 and 2 in particular.

In the cartridge B, the photosensitive drum 7 is rotated and the surface thereof is uniformly charged by the application of a voltage to the charging roller 8, which is the charging means. Then, a laser beam conforming to the image information from the optical means 1 is applied to the photosensitive drum 7 through an exposure opening portion 1*e* to thereby form a latent image. This latent image is developed by the developing means 10 by the use of the toner. The charging roller 8 is provided to be in contact with the photosensitive drum 7, and effects charging on the photosensitive drum 7. This charging roller 8 is driven to rotate by the photosensitive drum 7. Also, the developing means 10 supplies the toner to the developing area of the photosensitive drum 7 to thereby develop the latent image formed on the photosensitive drum 7.

In the developing means 10, the toner in a toner containing part 14 is fed out to a developing roller 12 (also called a developing sleeve) by the rotation of a toner feeding member 15. The developing sleeve 12 functioning as a developer carrying member containing a magnet 17 therein is then rotated. A toner layer having triboelectrification charges imparted thereto by a developing blade 18 is formed on the surface of the developing sleeve 12, and the toner is supplied to the developing area of the photosensitive drum 7. Then, the toner is shifted to the photosensitive drum 7 in conformity with the latent image to thereby form and visualize a toner image.

The developing blade 18 serves to prescribe the amount of toner on the peripheral surface of the developing sleeve 12 and also impart triboelectrification charges. Also, near this developing sleeve 12, there is rotatably mounted a toner agitating member 16 for circulating the toner in a developing chamber.

A voltage opposite in polarity to the toner image is then applied to the transferring roller 4, and the toner image formed on the photosensitive drum 7 is transferred to the recording medium 2. Thereafter, any residual toner on the photosensitive drum 7 is removed by cleaning means 9. The cleaning means 9 scrapes off the residual toner on the photosensitive drum 7 by an elastic cleaning blade 9*a* provided in abutting relationship with the photosensitive drum 7 and collects it into a waste toner reservoir 9*b*.

In the cartridge B, a toner container 11 having the toner containing portion 14 containing the toner therein and a developing frame body 13 for holding various constituent members including the developing sleeve 12 constituting the developing means 10 are coupled together. A cleaning frame body 9*c* having mounted thereon the photosensitive drum 7, the cleaning means 9, such as the blade 9*a,* and the charging roller 8 is coupled to the developing frame member.

The cartridge B is made detachably attachable to the image forming apparatus A by an operator user.

Also, the cartridge B is provided with the exposure opening portion 1*e* for applying therethrough a light conforming to the image information to the photosensitive drum 7, and a transfer opening portion 13*o* for opposing the photosensitive drum 7 to the recording medium 2. More particularly, the exposure opening portion 1*e* is provided in the cleaning frame body 9*c*. The transfer opening portion 13*o* is provided between the developing frame body 13 and the cleaning frame member 9*c*.

A description will now be provided of the construction of the housing of the cartridge B according to the present embodiment.

The cartridge B shown in the present embodiment has a housing constituted by the toner container 11 and the developing frame body 13 being coupled together, and the cleaning frame body 9*c* being pivotally coupled thereto. The photosensitive drum 7, the charging roller 8, the developing means 10 and the cleaning means 9 are contained in this housing and made into a cartridge. This cartridge B is detachably mounted with respect to cartridge mounting means provided in the image forming apparatus A and is used.

(Construction of the Housing of the Process Cartridge B)

The cartridge B according to the present embodiment is such that as previously described, the toner container 11, the developing frame body 13, and the cleaning frame body 9*c* are coupled together to thereby constitute a housing. This construction will hereinafter be described in detail.

As shown in FIG. 2, the toner feeding member 15 is pivotally mounted on the toner container 11.

Also, the developing sleeve 12 and the developing blade 18 are mounted on the developing frame body 13. Further, the agitating member 16 for circulating the toner in the developing chamber is rotatably mounted near the developing sleeve 12. Also, on the developing frame body 13, an antenna rod 89 is mounted in opposed relationship with the lengthwise direction of the developing sleeve 12 and substantially parallel to the developing sleeve 12.

The toner container 11 and the developing frame body 13 are welded together (ultrasonically welded together in the present embodiment) to thereby constitute an integral developing unit D.

A drum shutter member 20 for covering the photosensitive drum 7 to thereby protect it from being exposed to light for a long time or from contacting foreign substances when the cartridge B has been detached from the image forming apparatus A is mounted on the developing unit D.

Also, as shown in FIG. 2, the photosensitive drum 7, the charging roller 8 and the various members of the cleaning means 9 are mounted on the cleaning frame member 9*c* to thereby constitute a unit C.

The developing unit D and the unit C are pivotally coupled together by a pin 40 to thereby constitute the cartridge B.

Figure 27:
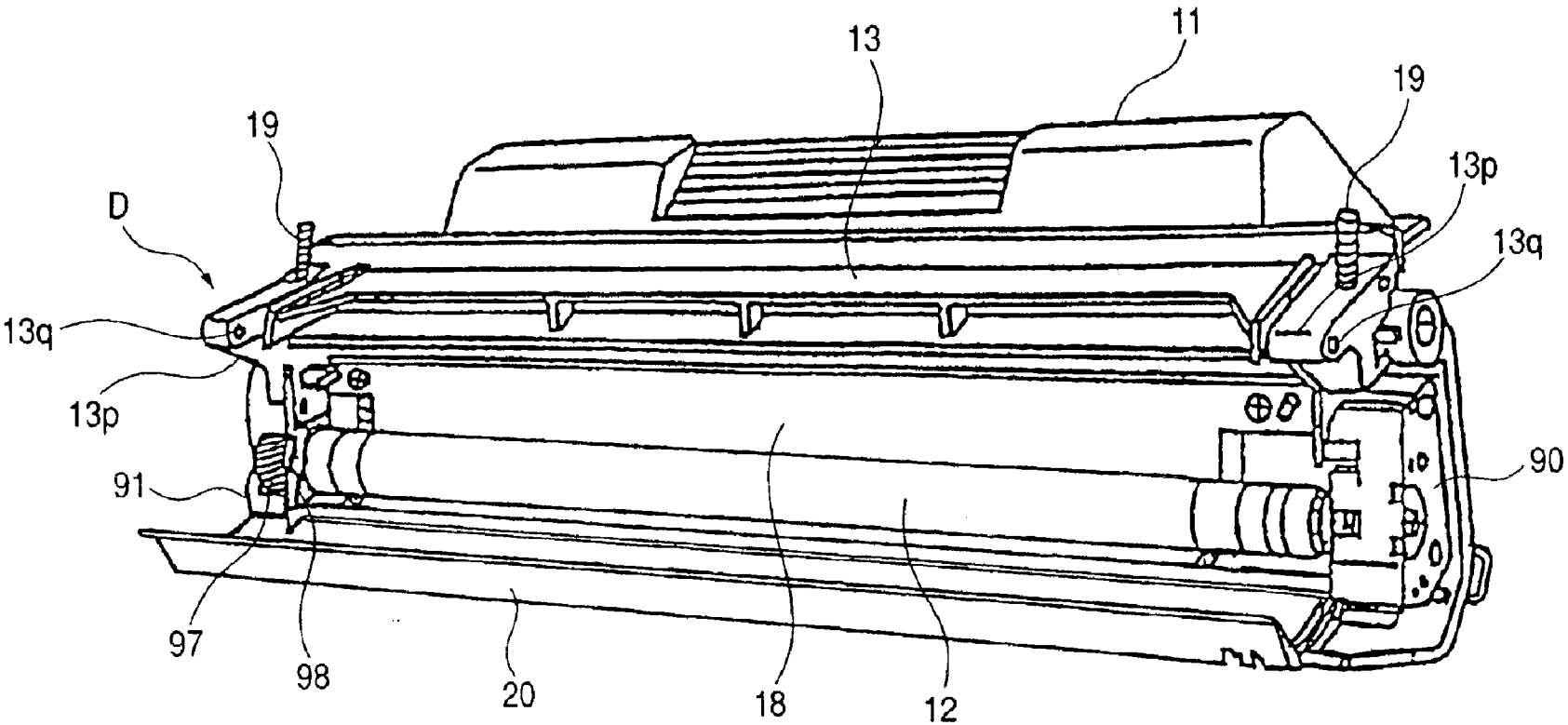
FIG. 27 is a perspective view showing the interior of the toner container according to the embodiment of the present invention.

That is, as shown in FIG. 27, round pivot holes 13*q* are formed in the tip ends of arm portions 13*p* formed on the lengthwise (axially of the developing sleeve 12) opposite sides of the developing frame body 13 parallel to the developing sleeve 12.

Figure 28:
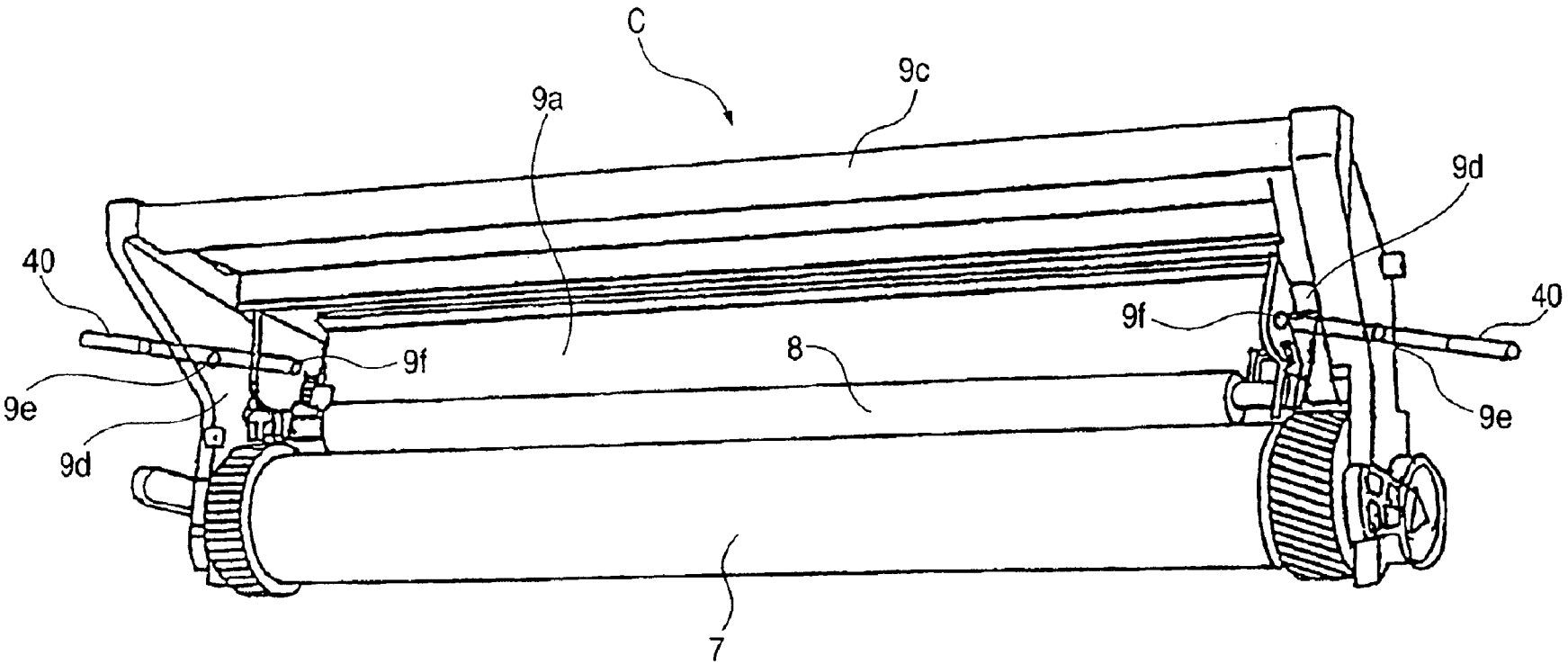
FIG. 28 is a perspective view showing the interior of a cleaning container according to the embodiment of the present invention.

On the other hand, recesses 9*d* for receiving the arm portions 13*p* therein are formed at two locations in the lengthwisely opposite sides of the cleaning frame body 9*c* (see FIG. 28).

The pin 40 is forced into the mounting hole 9*e* of the cleaning frame body 9*c* with the arm portions 13*p* inserted in the recesses 9*d*. The pin 40 is then fitted into the pivot holes 13*q* at the ends of the arm portions 13*p* and is further forced into inner holes 9*f* to thereby mount the pin. Thereby, the developing unit D and the unit C are coupled together for pivotal movement about the pin 40.

At this time, compression coil springs 19 are inserted onto and mounted on dowels (not shown) provided upright on the roots of the arm portions 13*p*. The compression coil springs 19 abut against the upper walls of the recesses 9*d* of the cleaning frame body 9*c*. Thus, the developing frame body 13 is downwardly biased by the springs 19, whereby the developing sleeve 12 is reliably urged against the photosensitive drum 7.

(Holder 90)

Figure 6:
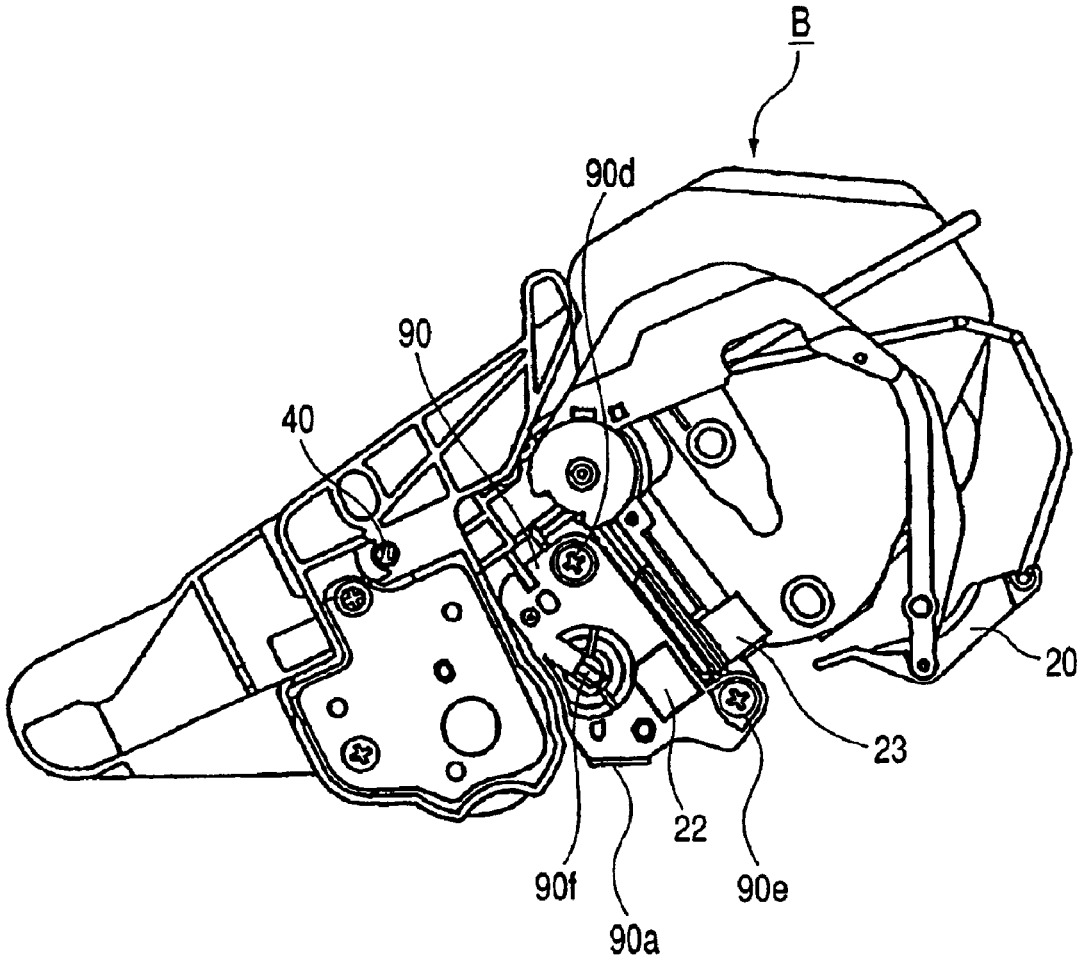
FIG. 6 is a side view of the process cartridge according to the embodiment of the present invention.
Figure 18:
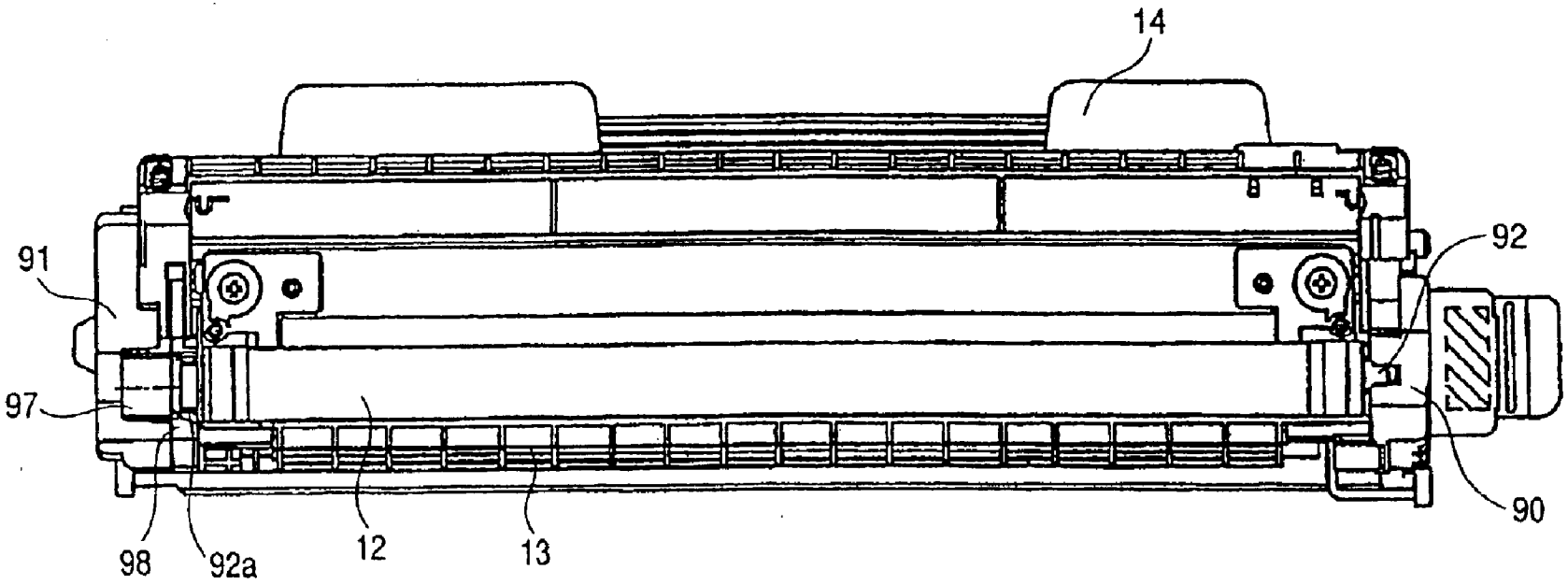
FIG. 18 is a front view of the developing frame body according to the embodiment of the present invention.

A holder 90 is mounted on one end of the developing frame body 13, as shown in FIGS. 6 and 18. As will be described later, holders are mounted on the developing frame body 13 at the opposite ends thereof. So, in order to distinguish between them, the one designated by the reference numeral 90, and the other one designated by the reference numeral 91.

A bearing 92 for rotatably supporting the developing sleeve 12 is mounted on the holder 90. The developing sleeve 12 is held by the holder 90 through the bearing 92. The developing sleeve 12 can also supported by the developing frame body 13 through the holder 90.

Figure 4:
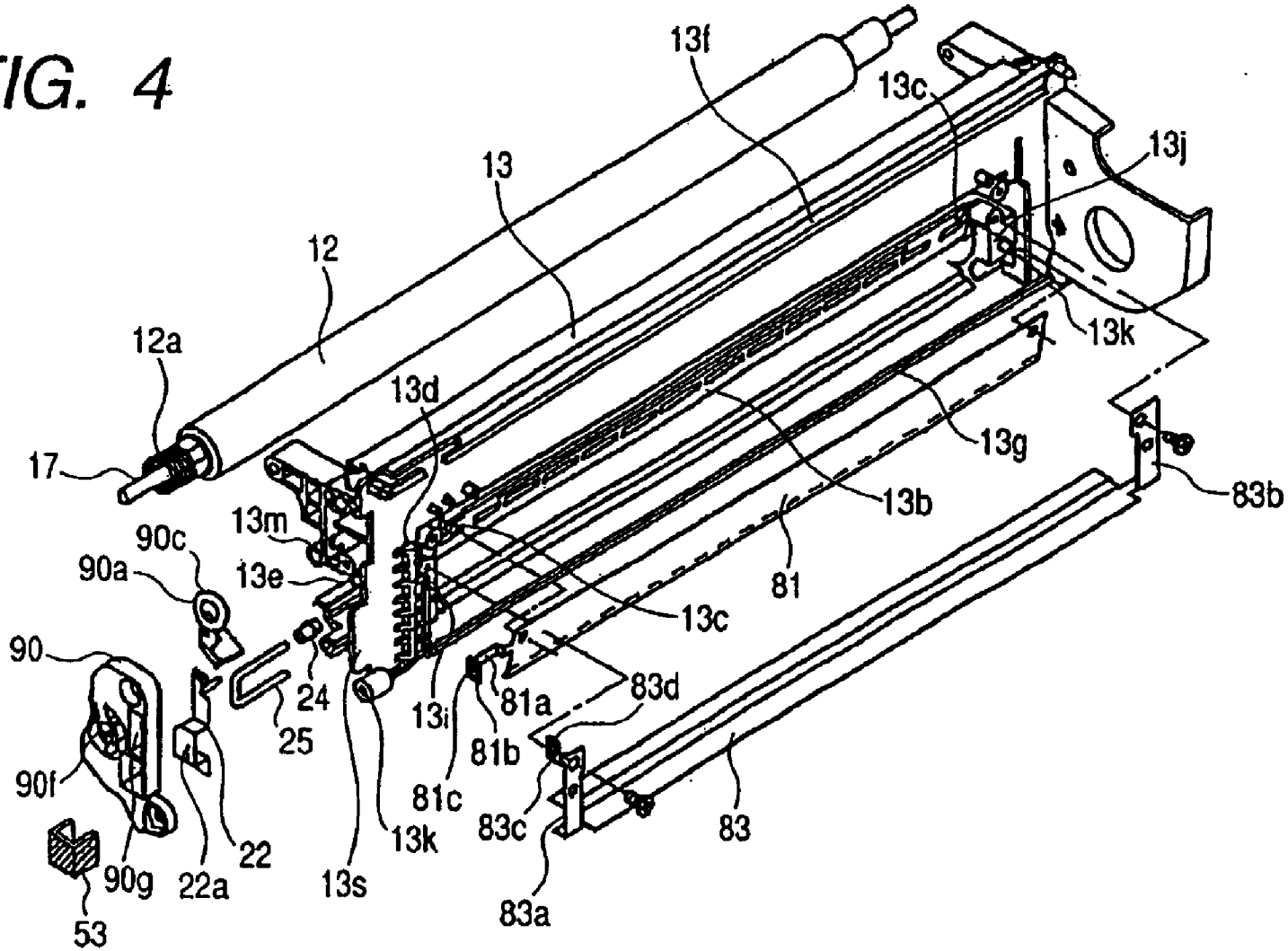
FIG. 4 is an exploded perspective view of the process cartridge according to the embodiment of the present invention.

The holder 90 is provided with a developing bias contact 90*a* for receiving a developing bias voltage from the image forming apparatus A and supplying it to the developing sleeve 12 (FIG. 4). Also, an electrical contact 22 for detecting the amount of toner which will be described later is mounted.

As described above, the holder 90 has the bearing 92, the developing bias contact 90*a* and the electrical contact 22 incorporated therein. The holder 90 is fixed to the developing frame body 13 with the developing sleeve 12 supported by the bearing 92. Also, the magnet 17 is held by a magnet supporting portion 90*f* provided on the holder 90 and is supported on the developing frame body 13.

Figure 5:
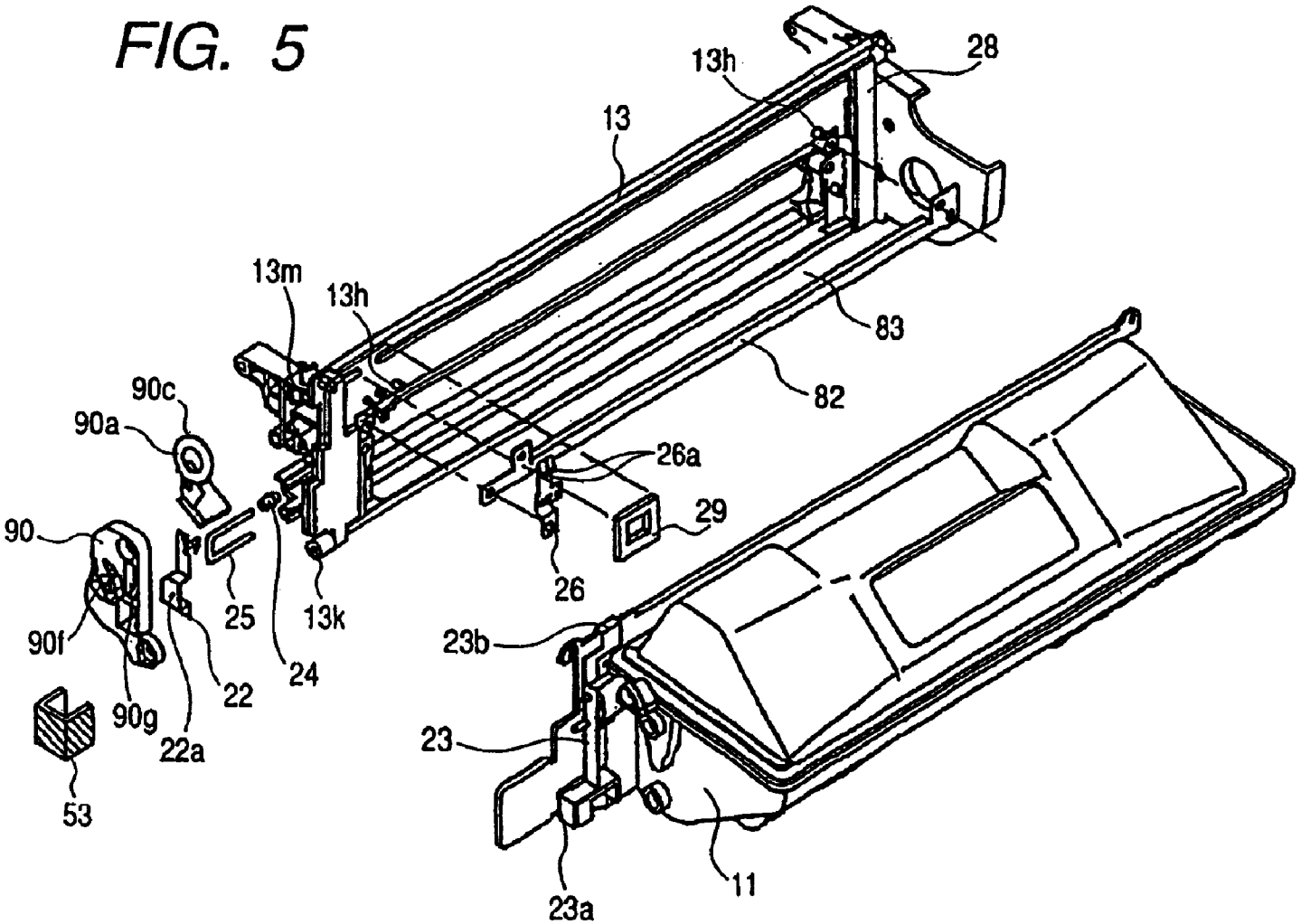
FIG. 5 is an exploded perspective view of the process cartridge according to the embodiment of the present invention.

As shown in FIG. 6, the holder 90 is fixed to the developing frame body 13 by a first screw 90*d* and a second screw 90*e*. Also, as shown in FIG. 5, a side of the developing frame body 13 is formed with a first screw hole 13*m* and a second screw hole 13*k* for receiving the first screw 90*d* and the second screw 90*e*, respectively, therein.

(Holder 91)

Figure 24:
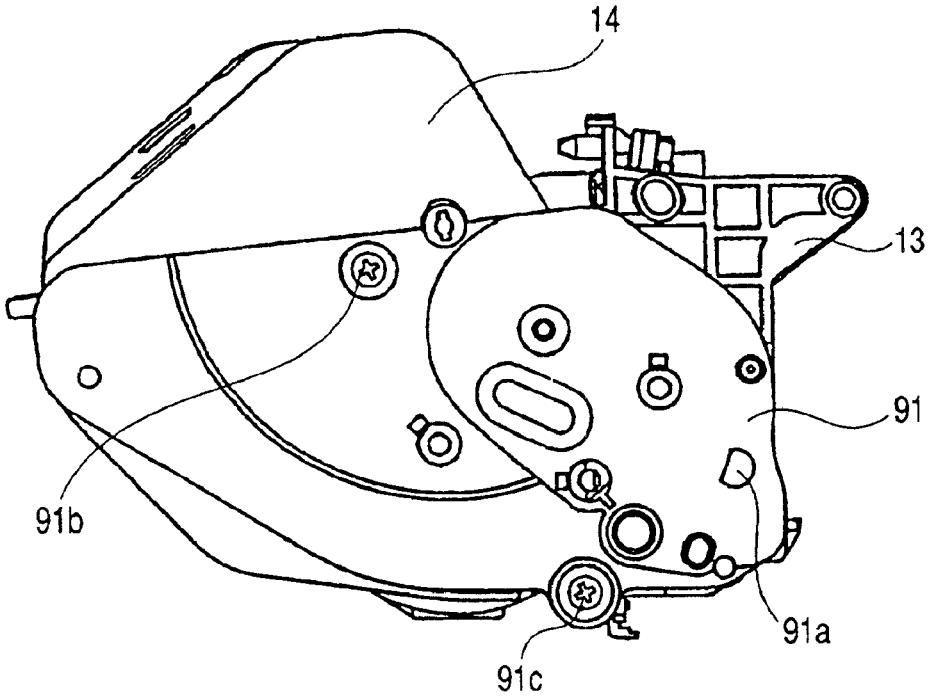
FIG. 24 is an illustration regarding the coupling of the developing frame body and the holder according to the embodiment of the present invention.

The holder 91 is mounted on the other end of the developing frame body 13 lengthwisely opposite to the side on which the aforedescribed holder 90 is mounted, as shown in FIGS. 18 and 24. Also, FIG. 17 is a view of the holder 91 as it is seen from its inside.

The holder 91 is provided with a magnet supporting portion 91*a* for fixedly supporting the magnet 17 contained in the developing sleeve 12 on the developing frame body 13. Thus, the magnet 17 is held by the holder 91 with the aid of the magnet supporting portion 91*a*. The magnet 17 can also be supported by the developing frame body 13 through the holder 91.

Figure 17:
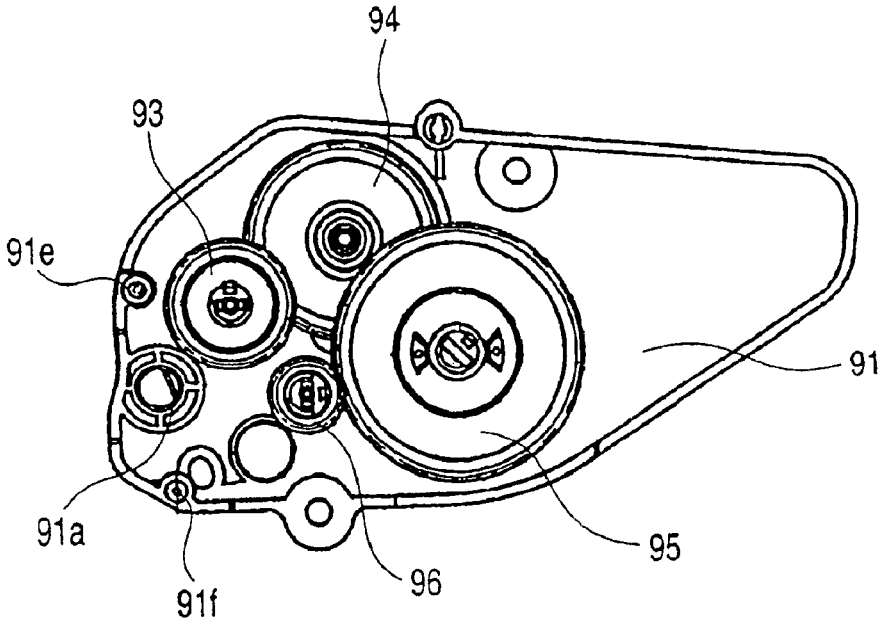
FIG. 17 is a side view of the inner side of the holder according to the embodiment of the present invention.

Also, the holder 91, as shown in FIG. 17, holds various gears for drive transmission. Specifically, the holder 91 has a first idler gear 93, a second idler gear 94, a toner container agitating gear 95 and a third idler gear 96 mounted thereon.

The first idler gear 93 receives a driving force from a sleeve gear 97 for rotating the developing sleeve 12 at a predetermined peripheral speed, which is shown in FIG. 18.

The second idler gear 94 receives a driving force from the first idler gear 93.

The agitating gear 95 receives a driving force from the second idler gear 94, and rotates the toner feeding member 15 provided in the toner containing part 14, which is shown in FIG. 2. The toner feeding member 15 feeds the toner in the toner containing part 14 into a developing chamber 13*a*.

The third idler gear 96 receives driven force from the agitating gear 95. It rotates a developing chamber agitating gear mounted on the toner agitating member 16 for agitating the toner in the developing chamber 13*a*. The toner agitating member 16 agitates the toner in the developing chamber 13*a*.

As described above, the holder 91 has the first idler gear 93, the second idler gear 94, the agitating gear 95 and the third idler gear 96 incorporated therein. The holder 91 is fixed to the developing frame body 13 with the magnet 17 supported by the magnet supporting portion 91*a*.

Figure 25:
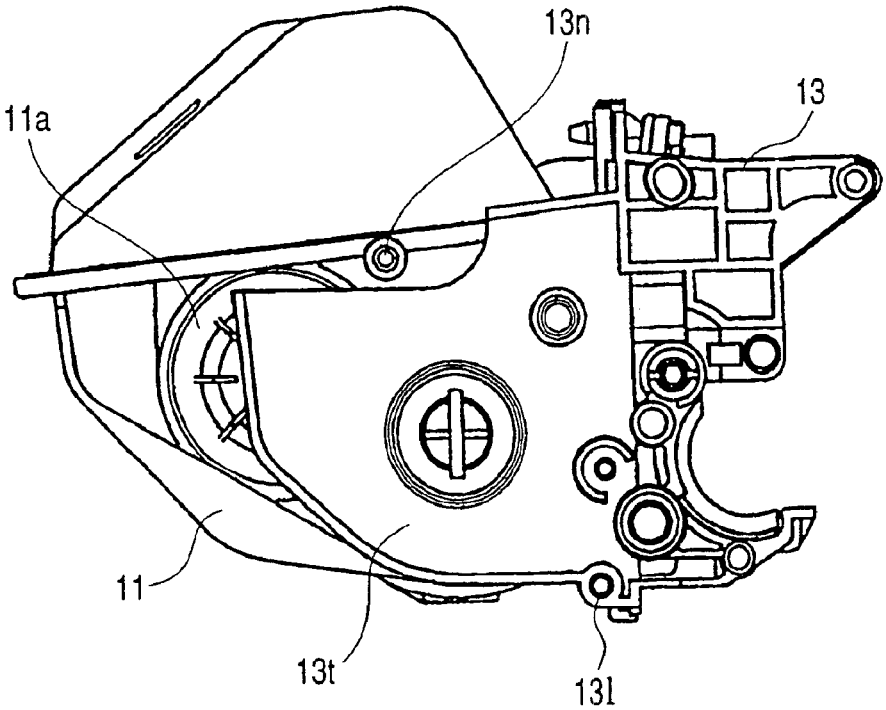
FIG. 25 is an illustration regarding the coupling of the developing frame body and the holder according to the embodiment of the present invention.

As shown in FIG. 24, the holder 91 is fixed to the developing frame body 13 by a first screw 91*b* and a second screw 91*c*. Also, as shown in FIG. 25, the toner container 11 is formed with a first screw hole 13*n* for receiving the first screw 91*b* therein. The developing frame body 13 is formed with a second screw hole 13*l* for receiving the second screw 91*c* therein.

Also, as shown in FIG. 18, a bearing 92*a* for rotatably supporting the developing sleeve 12 is held by a bearing holder 98. The developing sleeve 12 is held on the developing frame body 13 by the positioning pins 91*e* and 91*f* of the holder 91 shown in FIG. 17, through the bearing 92*a* and the bearing holder 98. Also, on the lengthwisely opposite side, as described above, the developing sleeve 12 is held on the developing frame body 13 through the bearing 92 and the holder 90.

Also, the cartridge B is provided with first toner amount detecting means and second toner amount detecting means for detecting the residual amount of toner in accordance with the consumption of the toner in the developing chamber 13*a*.

(First Detecting Means)

In the present embodiment, the first detecting means is such that as shown in FIGS. 2, 4, 5, and 8, FIG. 2, a first electrode 81, a second electrode 82 and a third electrode 83, functioning as measuring electrode members constituting a toner amount detecting portion, are disposed along the developing sleeve 12. The first electrode 81 and the third electrode 83, as will be described later, are electrically connected together in the developing frame body 13 and are at the same potential. The detecting means applies a voltage to one of the first electrode 81 and the second electrode 82 to thereby induce a capacitance between the electrodes. This capacitance is measured to thereby detect the amount of toner. In the present embodiment, the voltage is applied to the second electrode 82, which is used as an input side of the toner amount detection portion, and the first electrode 81 and the third electrode 83 are used as an output side of the toner amount detection portion.

The first electrode 81, the second electrode 82 and the third electrode 83 are disposed at locations into which the toner carried by the toner feeding member 15 comes. When the amount of toner in the cartridge B is great, the toner is pushed by the toner feeding member 15 into the space surrounded by the electrodes, and the capacitance between the electrodes continues to exhibit a high value. As the cartridge B is used, the toner is consumed and the height of the toner among the electrodes decreases and the capacitance also decreases. Finally, the toner near the distal end of the developing blade 18 for scraping off the toner on the surface of the developing sleeve 12 is consumed to thereby cause a blank on an image, and there is brought about a toner-absent state.

In the present embodiment, the developing bias voltage applied to the developing sleeve 12 is used as an input voltage, and the capacitance between the developing sleeve 12 and the first electrode 81 is also detected to thereby detect the toner-absent state. That is, the first detecting means can detect changes in the capacitance to thereby sequentially detect the amount of toner.

According to the image forming apparatus according to the present embodiment, the residual amount of toner in the cartridge B is sequentially detected. On the basis of the information, the consumed amount of toner is displayed to thereby call upon the user to prepare a fresh process cartridge or a supply cartridge. Further, it is possible to call upon the user to interchange the process cartridge or supply the toner by the detection information of toner absence.

(Second Detecting Means)

A description will now be provided of a second toner amount detecting device. The second toner amount detecting device, as shown in FIG. 2, is a portion of the antenna rod 89 composed of an electro-conductive material, e.g. a metal wire, provided along the lengthwise direction of the developing sleeve 12.

The antenna rod 89, if made of an electro-conductive material, performs the same action, but in the present embodiment, a non-magnetic SUS material is used for it so as not to affect the circulation of the toner. The antenna rod 89 is provided over the full length of the developing sleeve 12 at a predetermined distance from the developing sleeve 12.

The capacitance between this antenna rod 89 and the developing sleeve 12 is varied by the amount of toner present therebetween. So, a variation in this capacitance is detected as a variation in potential difference by the toner amount detecting contact of the image forming apparatus main body to thereby detect the amount of toner. The antenna rod 89, which is the second toner amount detecting device, does not sequentially detect the amount of toner like the aforedescribed first toner amount detecting device, but effects only the detection in the vicinity of toner absence.

As described above, the cartridge B according to the present embodiment is provided with the two toner amount detecting devices. As a result, the cartridge B is adapted to be capable of coping with both of an image forming apparatus main body having a mechanism for sequentially detecting the amount of toner and an image forming apparatus main body having no mechanism for sequentially detecting the amount of toner and effecting only the detection of the absence of toner.

A description will now be provided of a construction for mounting the first electrode 81, the second electrode 82, and the third electrode 83 in the first toner amount detecting device and the antenna rod 89, which is the second toner amount detecting device, onto the constructive portion of the developing apparatus.

The toner amount detecting devices provided by the first electrode 81, the second electrode 82, the third electrode 83, and the antenna rod 89 function by detecting the space surrounded by the first electrode 81, the second electrode 82, and the third electrode 83, or the capacitance between the antenna rod 89 and the developing sleeve 12. Accordingly, the positional accuracy of each electrode is very important. Particularly the intervals among the first electrode 81, the second electrode 82 and the third electrode 83 and the position of each electrode relative to the developing sleeve 12 and the developing blade 18 need be accurate in order to detect the amount of toner accurately.

Also, to accurately detect the time when the toner becomes exhausted and a blank portion on an image occurs, each electrode should be disposed near the developing sleeve 12 on which the toner remains to the last.

Figure 8:
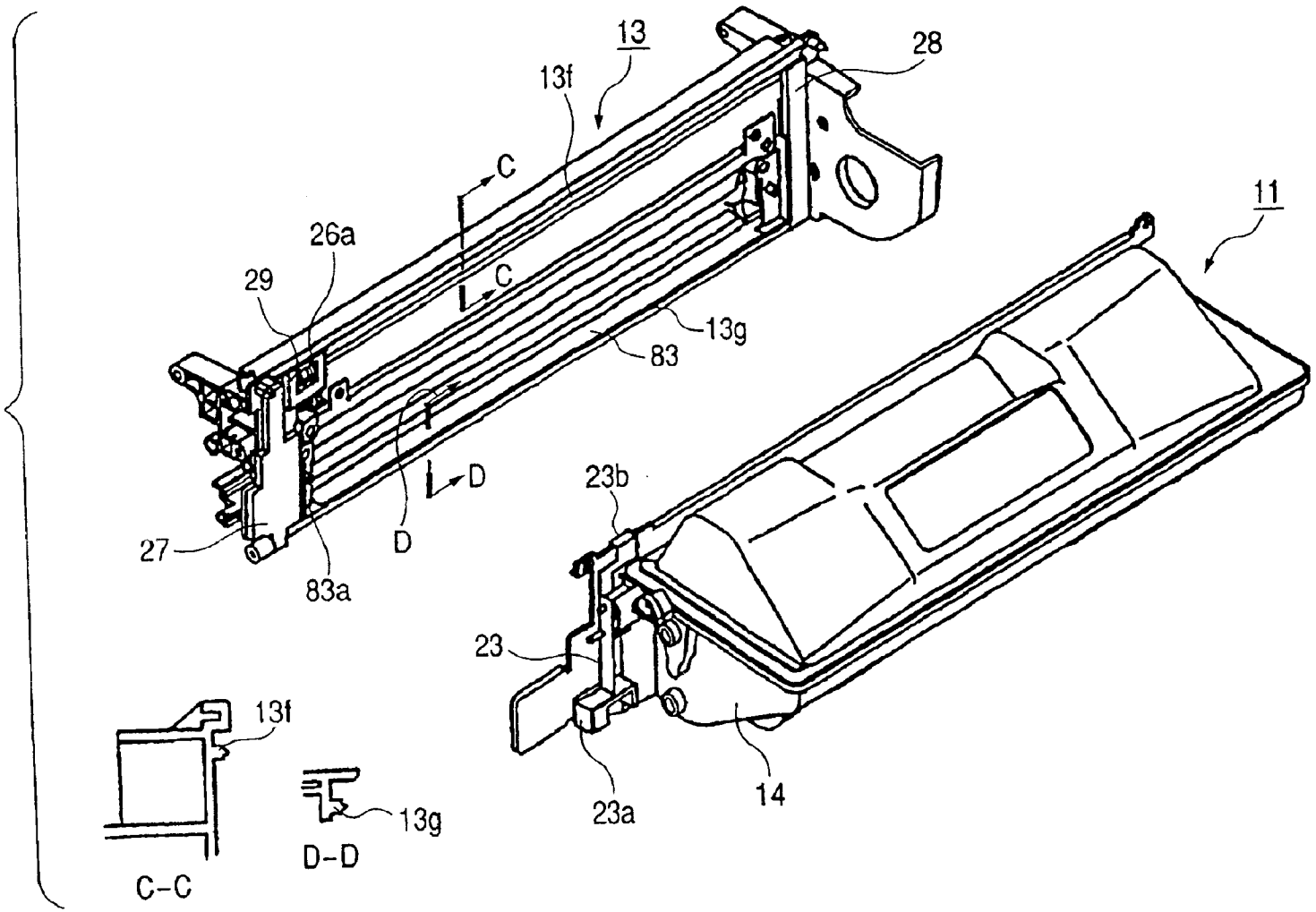
FIG. 8 is an exploded perspective view of the process cartridge according to the embodiment of the present invention.

So, in the present embodiment, as shown in FIGS. 4, 5 and 8, the first electrode 81, the second electrode 82, the third electrode 83, and the antenna rod 89 are mounted on a developing frame, i.e., the developing frame body 13.

(Mounting of the Electrodes)

The first electrode 81 is positioned by a positioning boss 13*c* provided on the mounting surface 13*b* of the developing frame body 13, and is stuck on the mounting surface 13*b* by a double-sided tape (see FIG. 4). The method of mounting the electrode is not restricted to using double-sided tape. Whatever method is employed, the first electrode 81 is provided near the developing sleeve 12 and the developing blade 18 on which the toner is consumed last, in order to detect a blank portion on the image accurately. Consequently, in some cases, it is difficult to secure a space for fastening screws to the developing frame body 13. Accordingly, in the present embodiment, the fixing by the double-sided tape, which does not require such a space, is adopted.

There is an arm portion (hook) 81*a* on one end portion of the first electrode 81, and that end portion is formed with a knocked-up portion 81*b*. The knocked-up portion 81*b* is adapted to come into the groove 13*d* of the developing frame body 13 when the first electrode 81 is mounted on the developing frame body 13. On the other hand, laterally of the groove 13*d* of the developing frame body 13, there is a hole 13*e* extending through the interior of the frame body to the outside, and the location thereof is designed to coincide with that of the hole 81*c* of the knocked-up portion 81*b*.

The third electrode 83 has arm portions 83*a* and 83*b* on the opposite ends thereof, and these arm portions are placed on and fixed to the mounting portions 13*i* and 13*j* of the developing frame body 13 by screws. A knocked-up portion 83*c* similar in shape to the knocked-up portion 81*b* of the first electrode 81 is formed on the end of the arm portion 83*a* and contains a hole 83*d*. The knocked-up portions 83*c* and 81*b* are designed to be in line when the third electrode 83 is mounted on the developing frame body 13.

The third electrode 83 is mounted on the developing frame body 13 after the mounting of the first electrode 81. When the third electrode 83 is incorporated into the developing apparatus, the knocked-up portion 83*c* contacts with the arm portion 81*a* of the first electrode 81. In this state, the holes of the knocked-up portions 81*b* and 83*c*, holes 81*c* and 83*d*, come to be in line. As a result, the knocked-up portion 83*c* of the third electrode 83 corrects the position of the knocked-up portion 81*c* of the first electrode 81 to thereby improve the assembling property of the press-in of an electrode bar 25 thereafter.

Also, the hole 13*e* of the developing frame body 13 is of a shape into which such an elastic seal member 24 as is disclosed in Japanese Patent Application Laid-Open No. H 8-314359 is fitted, and the elastic seal member 24 is pressed thereinto from the outside of the developing frame body.

Thereafter, the electrode bar 25 is inserted into the developing frame body 13 through the elastic seal member 24. The electrode bar is then pressed into the knocked-up portion 81*b* of the first electrode 81 and the knocked-up portion 83*c* of the third electrode 83, and the first electrode 81 and the third electrode 83 are electrically connected together.

As shown in FIGS. 5 and 8, the second electrode 82 is positioned by the positioning boss 13*h* of the developing frame body 13 and is fixed by screws. In this case, one of the screws fastens an electrode plate 26 and the second electrode 82 together, and effects wiring to the outside of the developing frame body 13. It is desirable that the second electrode 82 be assembled after the mounting of the first electrode 81 so as not to spoil the assembling property of the first electrode 81.

A description will now be provided of a coupling construction for the developing frame body 13 and the toner container 11 having the toner containing part 14.

Figure 11:
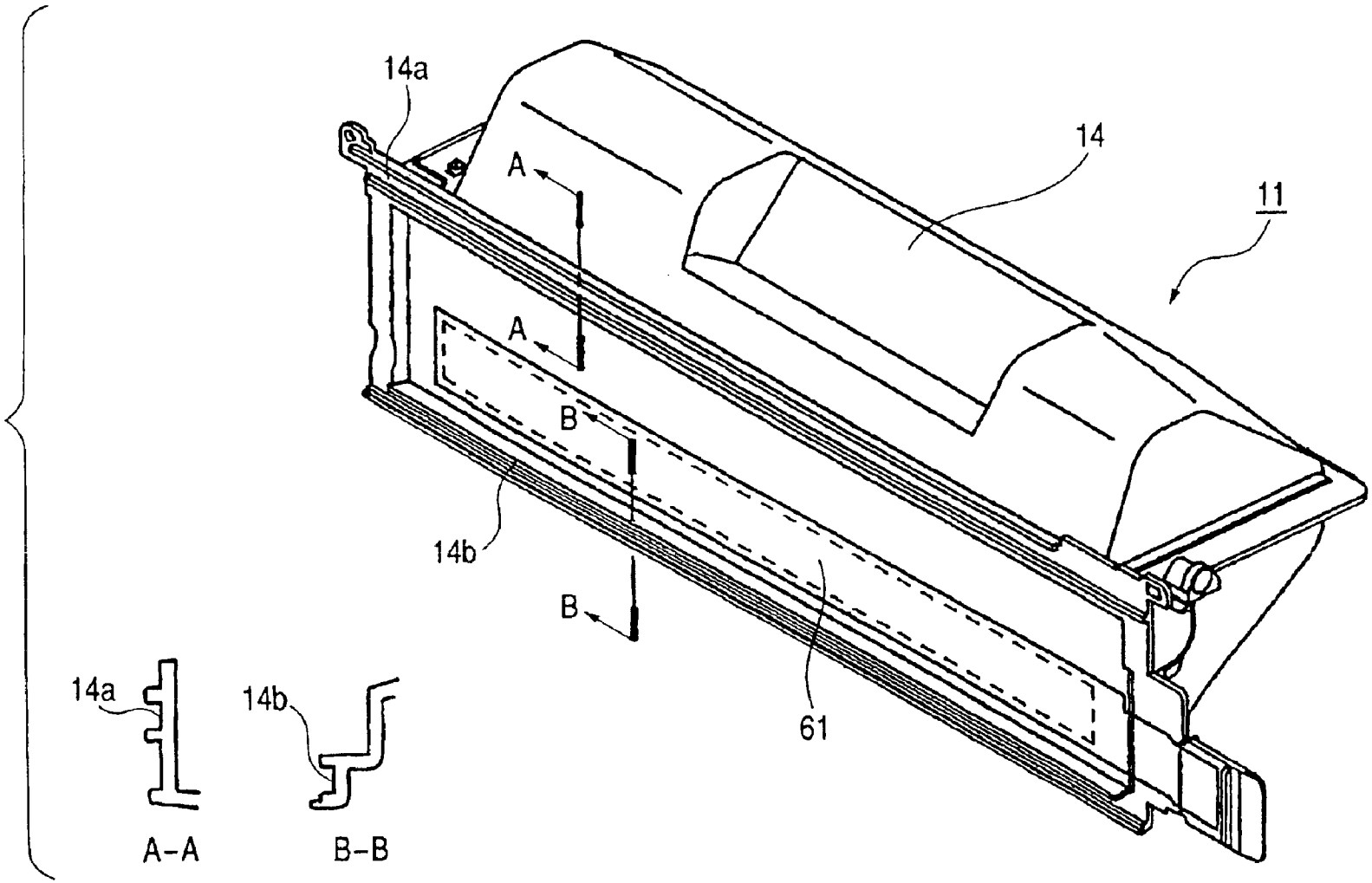
FIG. 11 is an illustration regarding the toner container in the reproducing process for the process cartridge according to the embodiment of the present invention.

As shown in FIGS. 8 and 11, the joined surface of the developing frame body 13 to the toner container 11 is formed with convex portions 13*f* and 13*g* fitted into concave coupling grooves 14*a* and 14*b*, respectively, formed in the toner containing part 14. On the top surfaces of these convex portions 13*f* and 13*g*, there are provided triangular ribs for use when ultrasonic welding is effected, as shown in cross-sectional views C—C and D—D in FIG. 8. Also, seal members 27, 28 and 29 for preventing the leakage of the toner from between the developing frame body 13 and the toner containing part 14 are stuck around the opposite end portions of the developing frame body 13 and the contact portion 26*a* of the electrode plate 26. As the seal members 27, 28 and 29, use is made of a sponge-like material.

The developing frame body 13 and the toner container 11 after each part has been incorporated thereinto are pressed with the convex portions 13*f* and 13*g* of the developing frame body fitted in the concave grooves of the toner containing part 14, and ultrasonic vibration is applied to between the concave grooves and the convex portions. Thereupon, the triangular ribs are melted by frictional heat and are welded to the bottoms of the concave grooves, whereby the developing frame body 13 and the toner container 11 are coupled integrally with each other.

In the present construction, an electrical contact 23 is attached to the toner container 11. The electrical contact 23 is provided with a contact portion 23*a*, contactable with the image forming apparatus main body and a contact portion 23*b*, contactable with the electrode plate 26, and the contact portion 23*b* and the electrode plate 26 are electrically connected together when the developing frame body 13 and the toner container 11 are coupled together.

(Assembly of the holder and Connection of the Electrical Contact)

As shown in FIG. 4, the electrical contact 22 is provided with a contact portion 22*a*, which contacts the electrode bar 25 when the holder 90 is mounted on the developing frame body 13. Consequently, the electrical contact 22 and the first electrode 81 and the third electrode 83 are electrically connected together.

Also, a contact spring 12*a* provided on one end of the developing sleeve 12 is electrically connected to a contact portion 90*c* provided on a developing bias contact 90*a*. A predetermined developing bias is applied to the developing sleeve 12.

Figure 7:
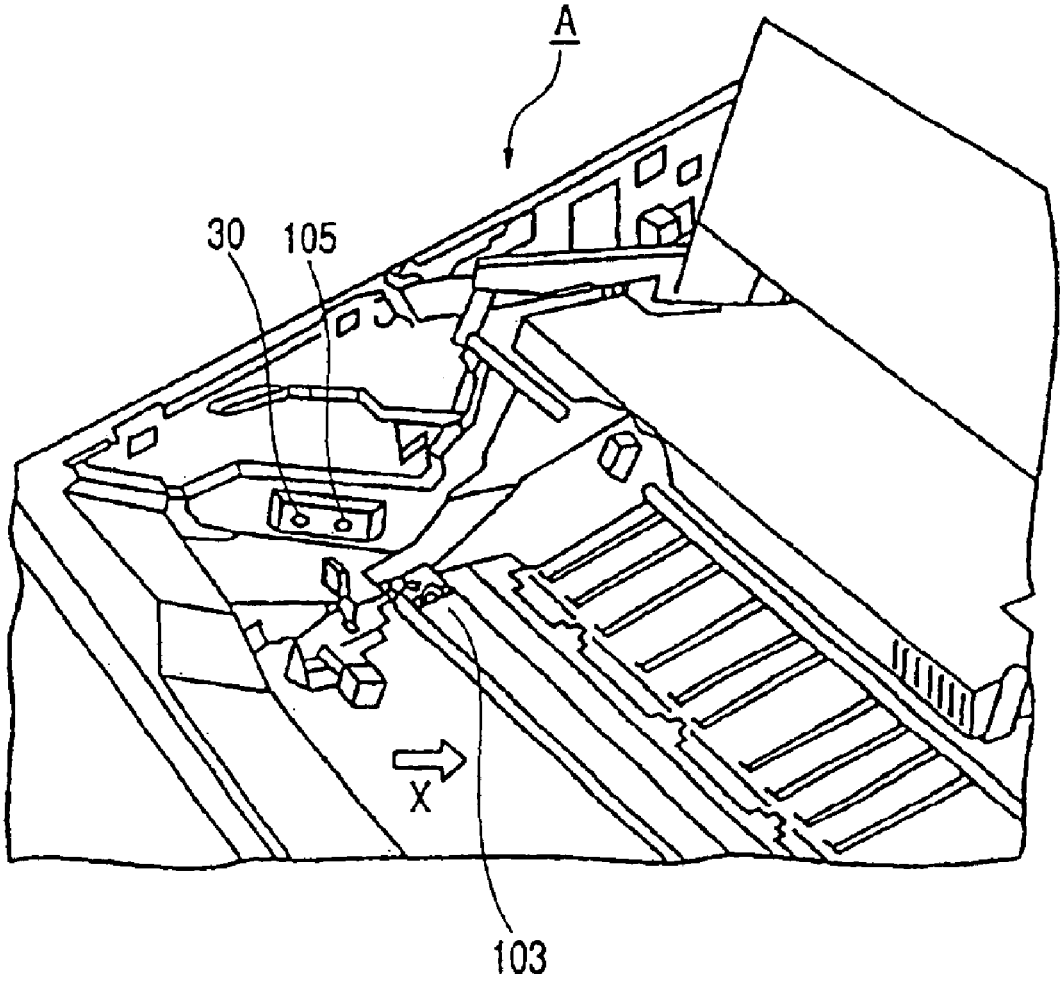
FIG. 7 is a perspective view showing a mounting portion for the process cartridge in the image forming apparatus according to the embodiment of the present invention.

On a side of the thus assembled cartridge B, as shown in FIG. 6, there are disposed the electrical contacts 22 and 23 of the toner amount detecting device and the developing bias contact 90*a*. As a result, these contacts, as shown in FIG. 7, are electrically connected to toner amount detecting contacts 30, 105 and a developing bias contact 103 disposed in the image forming apparatus main body when the cartridge B is mounted on the image forming apparatus A in the direction of X.

[Method of Disassembling and Reproducing the Process Cartridge B]

(Method of Disassembling the Cartridge B)

Figure 30:
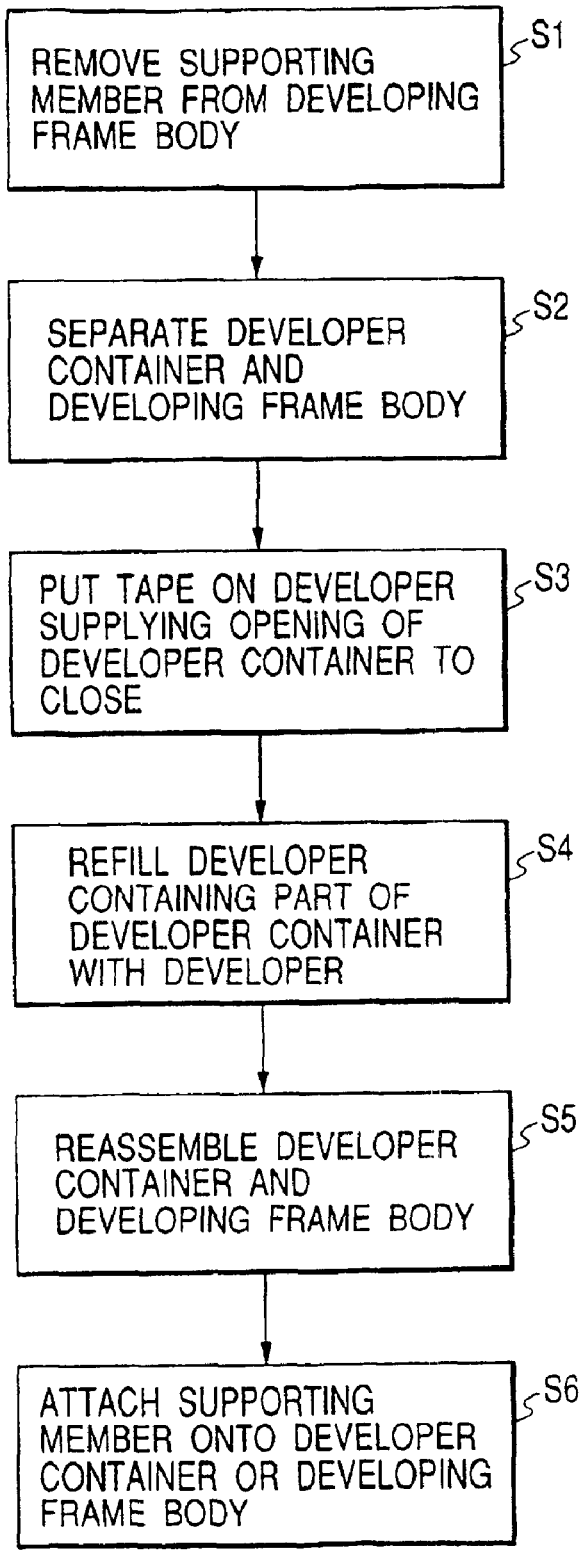
FIG. 30 is a flow chart showing a method of producing the process cartridge or the developing apparatus of the present invention.

A description will now be provided of a method of disassembling the cartridge B. The process of disassembling is shown in FIG. 30.

First, the aforedescribed coupling pin 40 is pulled out from the outside or pushed out from the inside to thereby divide the unit C and the developing unit D.

The unit C is reproduced by cleaning the waste toner in the waste toner reservoir 9*b,* and reproducing or interchanging the photosensitive drum 7, the cleaning means 9 comprised of the cleaning blade 9*a,* etc., and the charging roller 8.

(Method of Disassembling the Developing Unit D)

The first screw 90*d* and the second screw 90*e* shown in FIG. 6 are removed to thereby remove from the developing frame body 13 the holder 90 which is a supporting member fixed to the developing frame body 13. Also, the first screw 91*b* and the second screw 91*c* shown in FIG. 24 are removed to thereby remove from the developing frame body 13 the holder 91, which is a supporting member (the step of removing the supporting member, S1 in FIG. 30).

Thereafter, the developing sleeve 12 and the developing blade 18 are removed, and the developing frame body 13 and the toner container 11 are separated from each other (the step of separating the developing frame body S2 in FIG. 30).

As previously described, the developing frame body 13 and the toner container 11 are coupled together as by ultrasonic welding and cannot be easily separated from each other.

Figure 9:
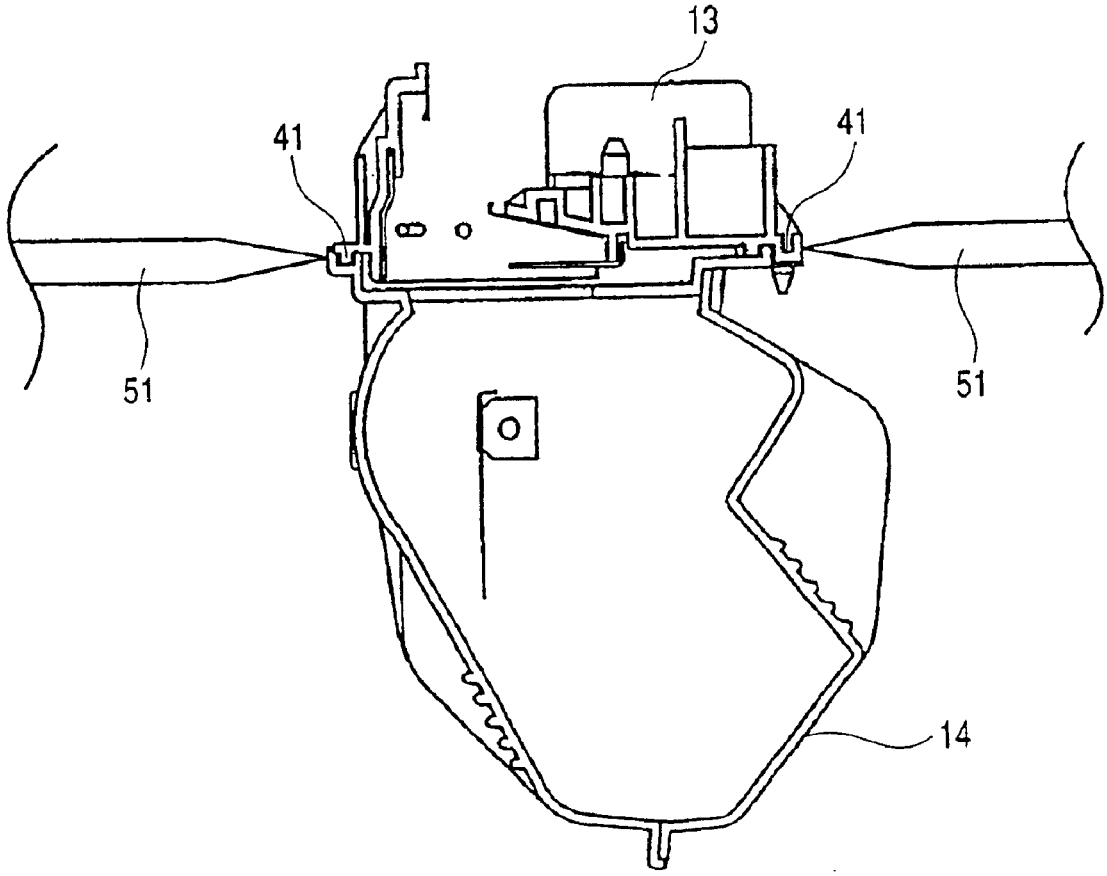
FIG. 9 is an illustration of the step of separating a developing frame body and a toner container from each other in a reproducing process for the process cartridge according to the embodiment of the present invention.

So, to separate the developing frame body 13 and the toner container 11 from each other, the welded surfaces thereof are cut by a cutter 51 as shown in FIG. 9, or are cut by ultrasonic cutting work (not shown) or laser beam machining or the like (not shown).

Figure 10:
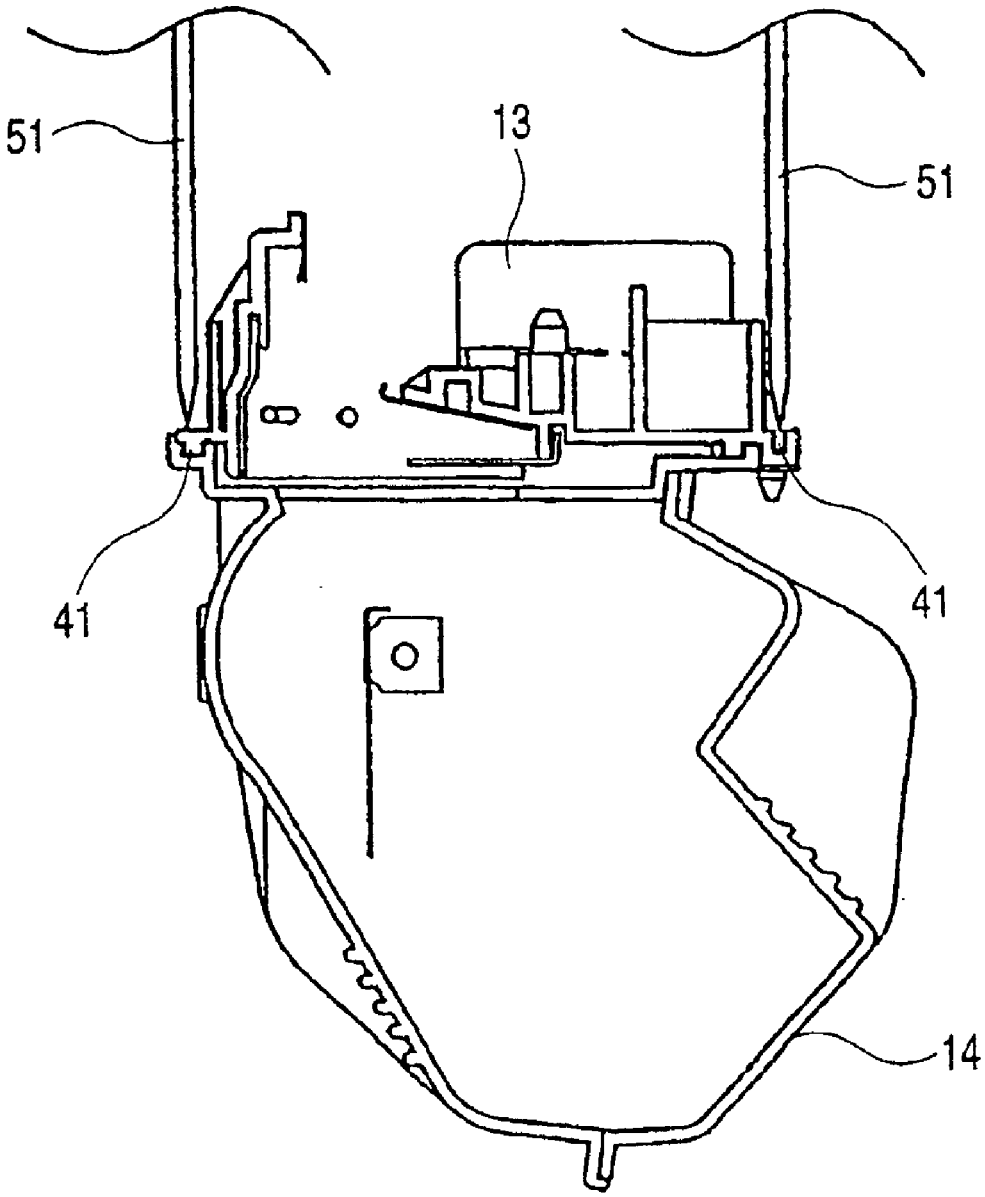
FIG. 10 is an illustration of the step of separating the developing frame body and the toner container from each other in the reproducing process for the process cartridge according to the embodiment of the present invention.

Describing the case of the cutter 51, the place to be cut is the joined surface 41, which is cut by cutting a welded joint portion thereof as shown in FIG. 9. Otherwise, as shown in FIG. 10, the welded portion may be avoided and cutting may be done along the joined surface 41. The ultrasonic cutting work is also similar in that ultrasonic vibration is applied to the cutter 51. In the case of the laser beam machining, the reach distance of a laser beam is designed to be limited to the portion to be cut.

(Method of Coupling the Developing Frame Body 13 and the Toner Container 11 Together)

The cleaning of the toner in the toner containing portion 14 is provided in the separated toner container 11. Then, as shown in FIG. 11, a toner seal member 61 is fixed to the opening portion, which is a toner supplying opening, by heat welding, bonding, a double-sided tape or the like to thereby reseal the opening portion (the sticking step, S3 in FIG. 30). The opening portion provided in the toner containing part 14 is provided on a side opposed to the developing frame body 13 for the purpose of supplying the toner toward the photosensitive drum 7.

After the toner seal member 61 has been stuck, refill with a fresh toner is effected (the step of refilling with the developer, S4 in FIG. 30).

Figure 12:
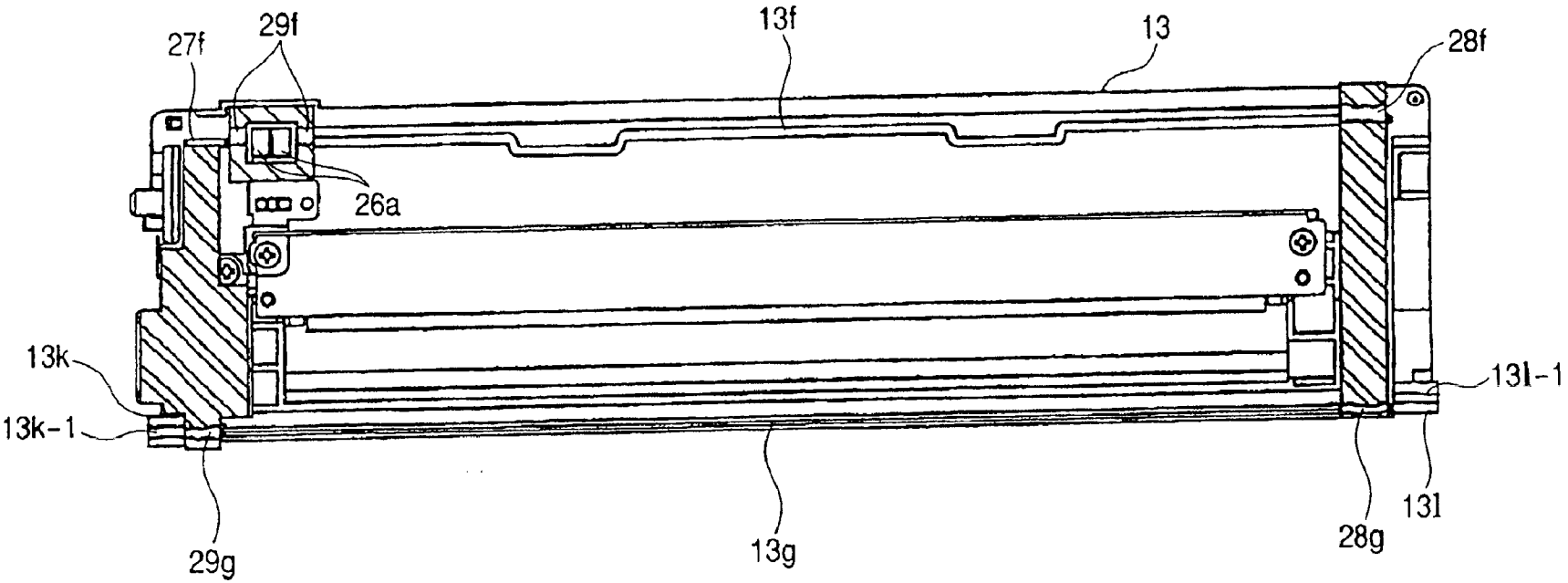
FIG. 12 is an illustration regarding the developing frame body in the reproducing process for the process cartridge according to the embodiment of the present invention.

The disassembled developing frame body 13, as shown in FIG. 12, is in a state in which the overlapping portions 27*f,* 28*f,* 29*f,* 28*g* and 29*g* of the triangular ribs of the convex portions 13*f* and 13*g* are melted and coupled together by an ultrasonic wave during coupling and the convex portions 13*f* and 13*g* and the seal members 27, 28 and 29 are melted and solidified. Therefore, it is necessary to perform this sealing operation so that the toner may not leak from these portions when recoupling has been done.

Figure 13:
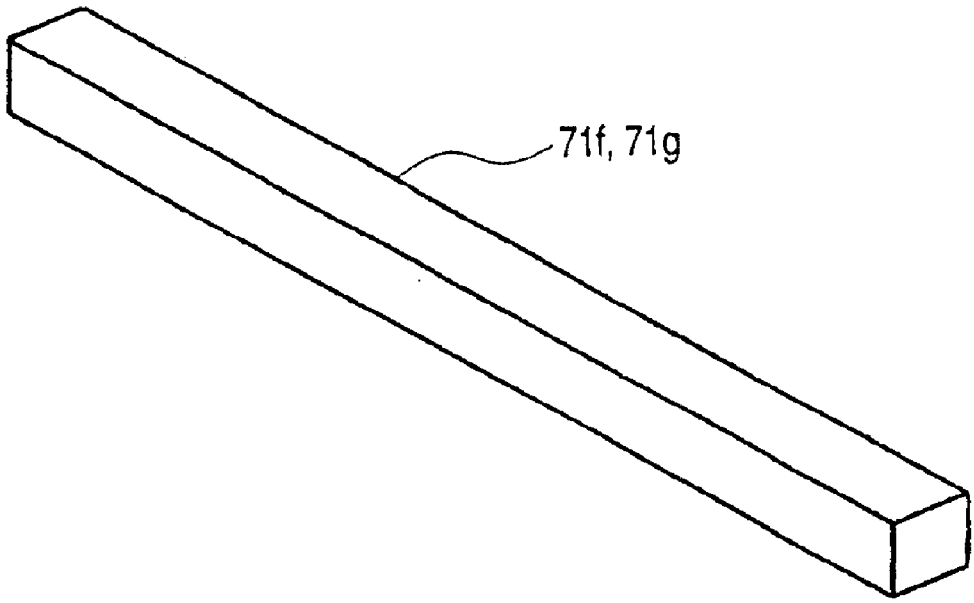
FIG. 13 is a perspective view of a seal member used in the reproducing process for the process cartridge according to the embodiment of the present invention.
Figure 14:
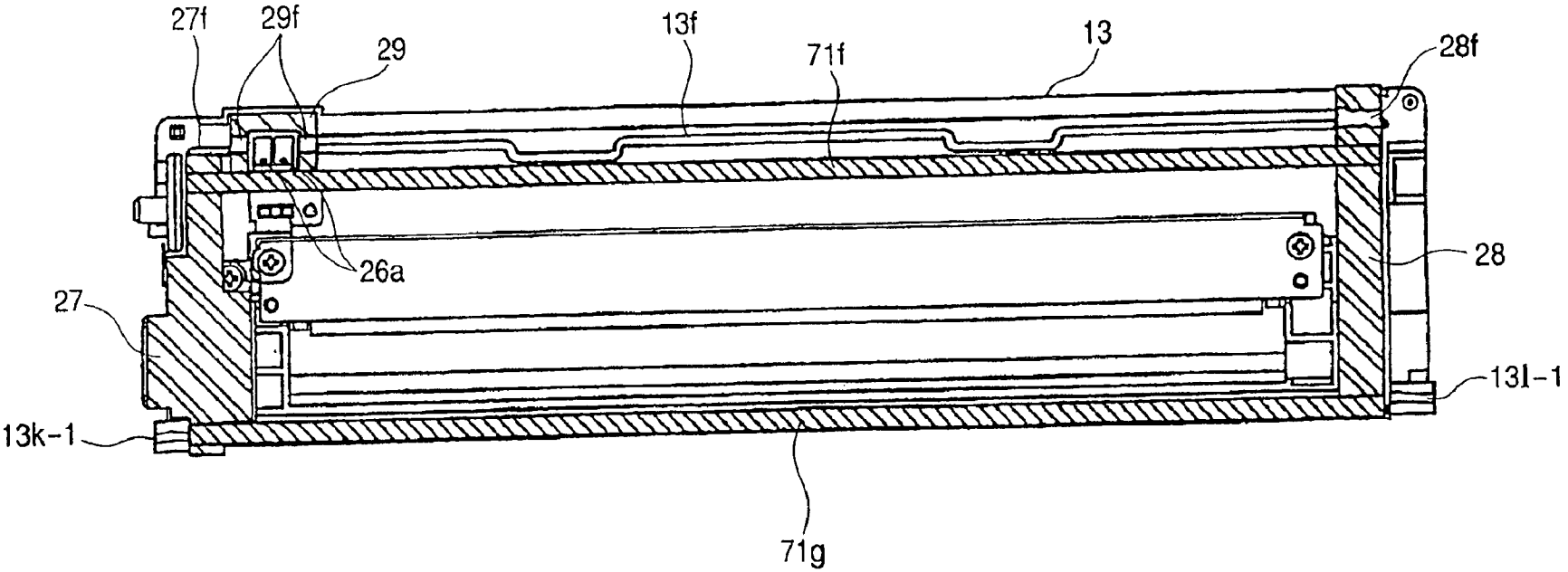
FIG. 14 is an illustration regarding the developing frame body in the reproducing process for the process cartridge according to the embodiment of the present invention.

So, as shown in FIG. 14, a sponge-like seal member 71*f* (see FIG. 13) is stuck on the opening side of the toner containing part 14 rather than on the overlapping portions 27*f,* 28*f* and 29*f,* astride the seal members 27, 28 and 29, to thereby seal the upper side of the frame body. Likewise, a seal member 71*g* is stuck on the opening side rather than on the overlapping portions 28*g* and 29*g* shown in FIG. 12 to thereby seal the lower side of the frame body.

Figure 15:
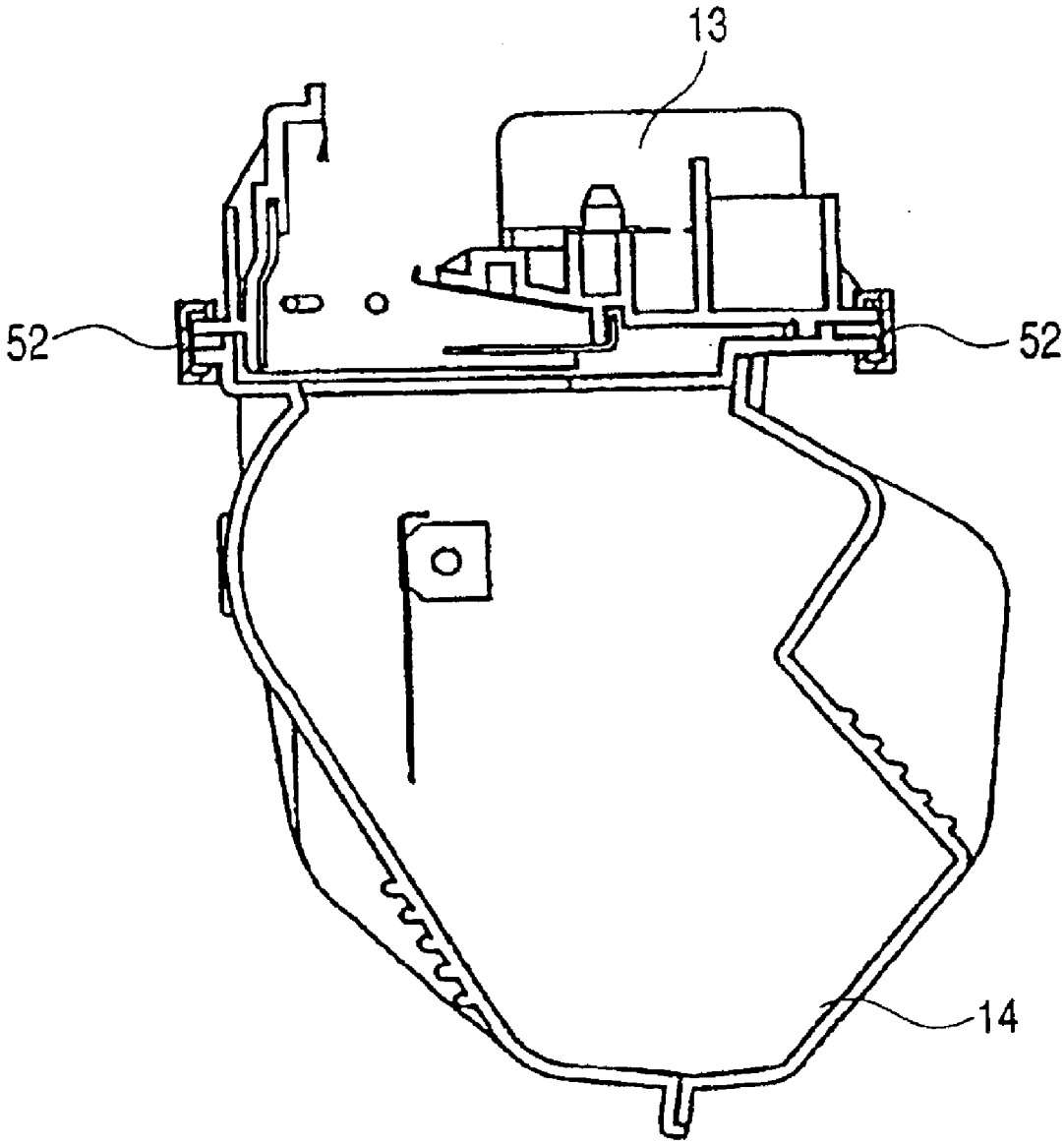
FIG. 15 is an illustration of the step of coupling the developing frame body and the toner container together in the reproducing process for the process cartridge according to the embodiment of the present invention.

Thereafter, the recyclable developing frame body 13 and toner container 11 are coupled together by coupling fittings 52, each of which is a clip made of a spring material having a U-shaped cross section as shown in FIG. 15 (the developing frame body coupling step: S5 in FIG. 30).

Regarding the coupling of these, however, it is also possible to accomplish it by the use of not only the coupling fittings 52, but also a method such as screwing, bonding, double-sided-tape sticking, ultrasonic welding or heat welding.

(Mounting of the Sleeve Unit)

The bearing 92*a,* the bearing holder 98 for supporting it, the developing sleeve 12 and the developing blade 18 are mounted on the coupled developing frame body 13 by diversion, reproduction or interchange.

(Mounting of the Holders)

Due to the above-described separation (by cutting) of the developing frame body 13 and the toner container 11, the second screw holes 13*k* and 13*l* for fixing the holder 90 and the holder 91 to the developing frame body 13 become unusable. That is, these second screw holes 13*k* and 13*l* are cut along a cutting surface by the cutter 51. Then, as shown in FIG. 12, cutting surfaces 13*k*–1 and 13*l*–1 are formed on the lengthwise extensions of the triangular ribs.

Figure 3A:
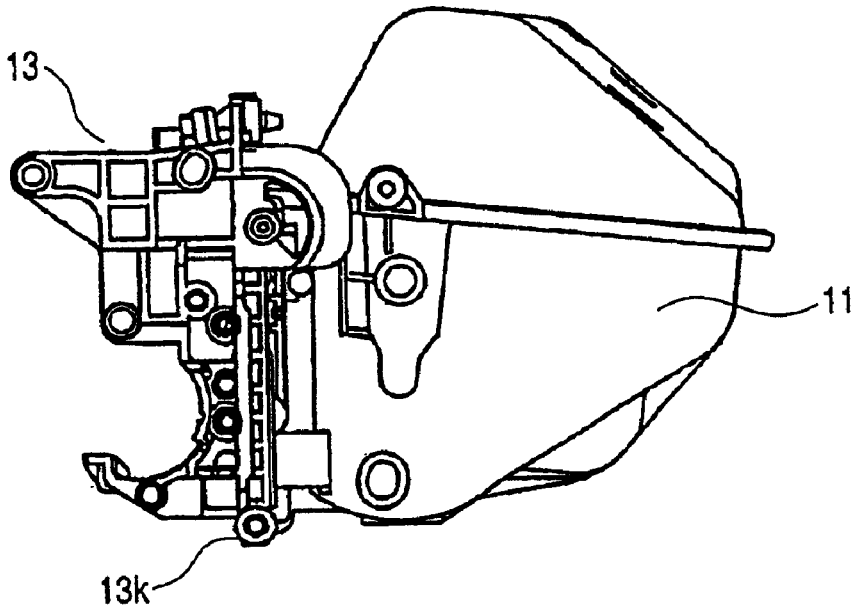
FIG. 3A is a side view of the process cartridge before a developing frame body separating step according to an embodiment of the present invention.
Figure 3B:
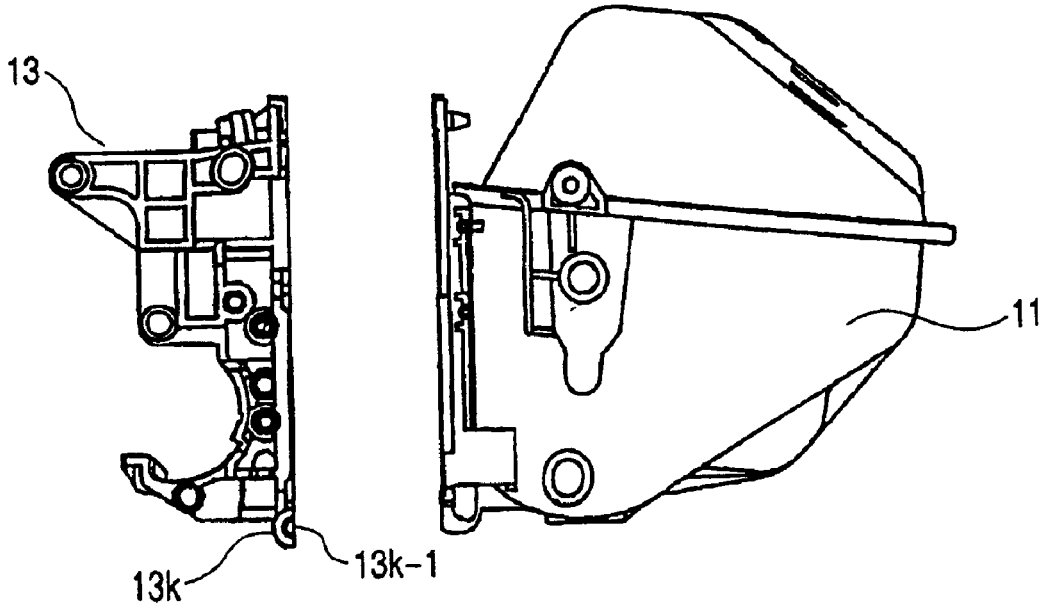
FIG. 3B is a side view of the process cartridge after the developing frame body separating step according to the embodiment of the present invention.
Figure 29A:
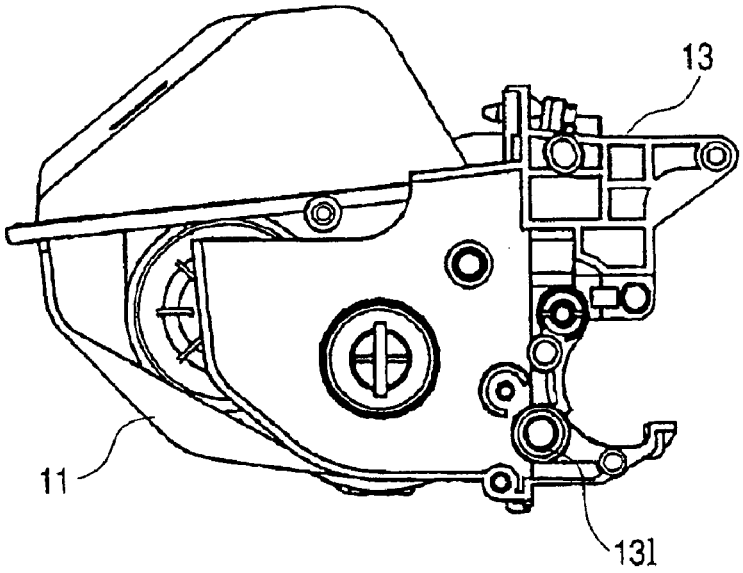
FIG. 29A is a side view of the process cartridge before the developing frame body separating step according to an embodiment of the present invention.
Figure 29B:
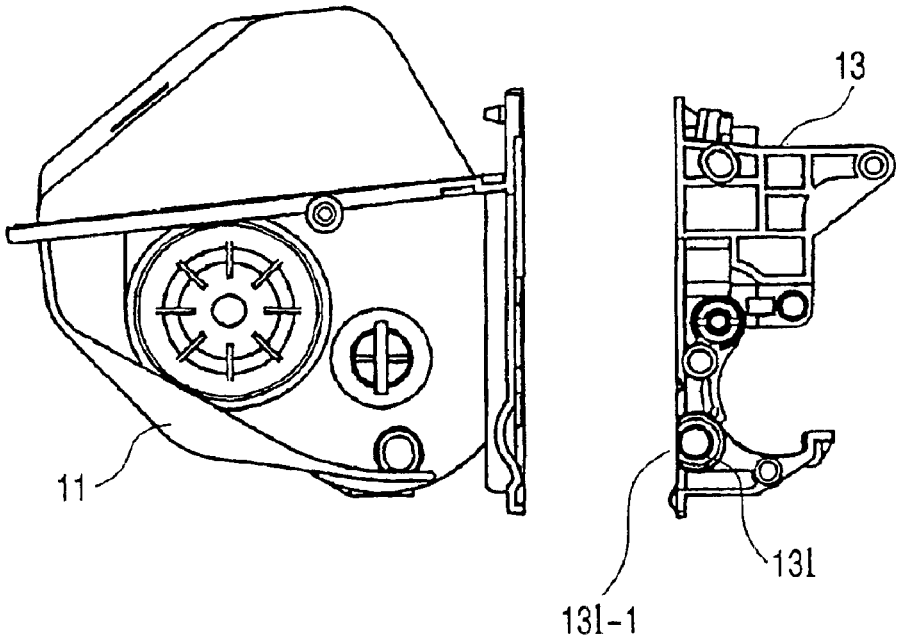
FIG. 29B is a side view of the process cartridge after the developing frame body separating step according to the embodiment of the present invention.

That is, the second screw holes 13*k* and 13*l* are provided on the lengthwise extension on the joined surface 41, which is the joint portion at which the developing frame body 13 is joined with the toner container 11 and near the joined surface 41. Consequently, the second screw holes 13*k* and 13*l* are also cut when, as shown in FIGS. 9 and 10, the developing frame body 13 and the toner container 11 are separated from the joined surface 41 by the use of the cutter 51. FIGS. 3A and 29A show the states of the second screw holes 13*k* and 13*l* before the developing frame body 13 is separated from the toner container 11. Also, FIGS. 3B and 29B show the states of the second screw holes 13*k* and 13*l* after the separation. As can be seen from these figures, the second screw holes 13*k* and 13*l* are cut into a state in which they cannot be used again as screw holes. Separating the developing frame body 13 from the toner container 11 in such a manner as not to damage the second screw holes 13*k* and 13*l* requires the cutting work by the cutter 51 to be done cautiously, and requires many working steps (a long time). Consequently, when the number of working steps is taken into account, it is more efficient to cut the second screw holes 13*k* and 13*l* provided on the lengthwise extensions on the joined surface 41 and near the joined surface 41 when the cutting work by the cutter 51 is done, and as a result, the number of the working steps can be improved.

Figure 16:
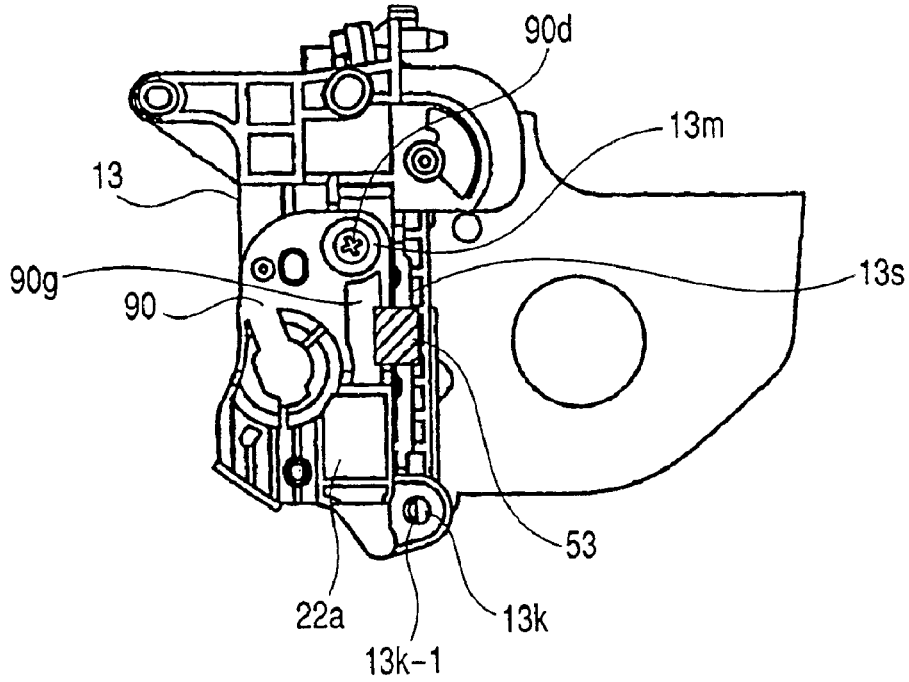
FIG. 16 is an illustration regarding the coupling of a holder in the reproducing process for the process cartridge according to the embodiment of the present invention.
Figure 19:
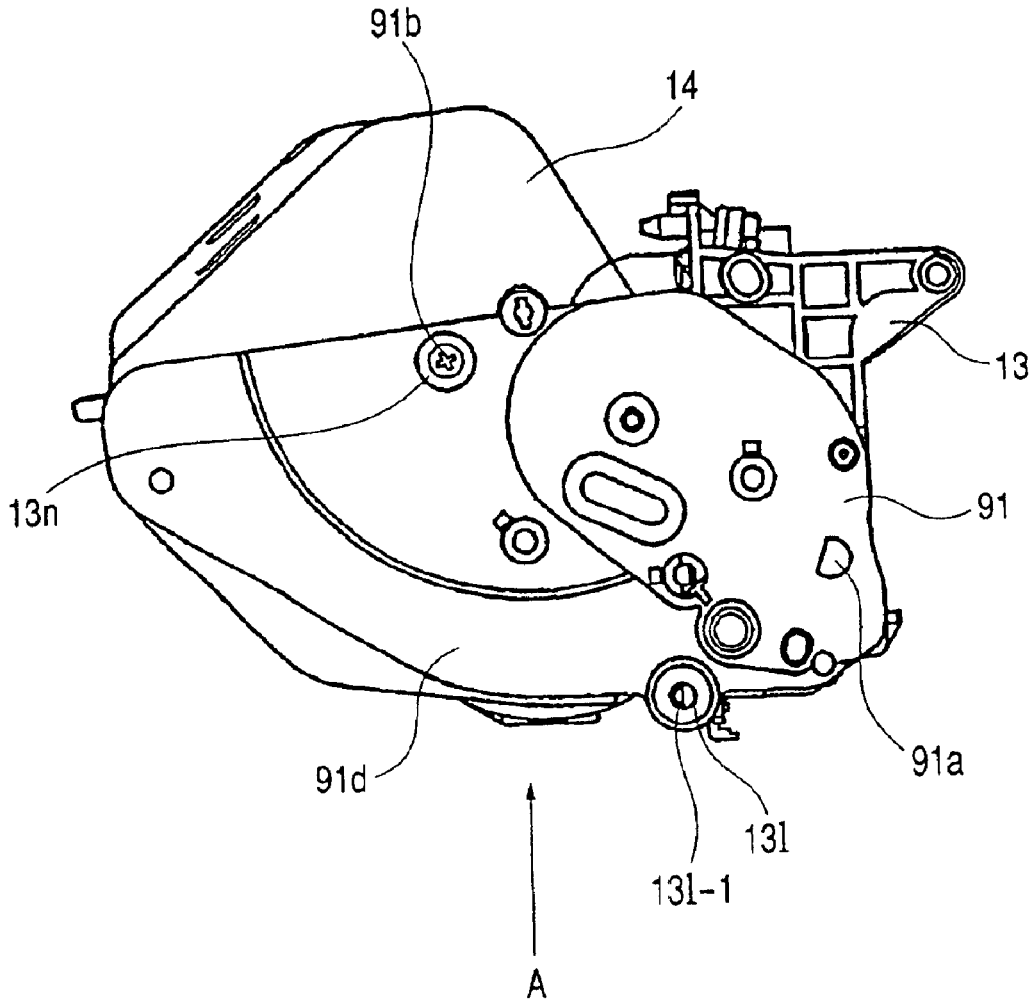
FIG. 19 is an illustration regarding the coupling of the developing frame body and the holder according to the embodiment of the present invention.

Therefore, the screwing by these second screw holes 13*k* and 13*l* becomes impossible when reassembly, which will be described later, is effected thereafter. Accordingly, the screwing portions for fixing the holder 90 and the holder 91 to the developing frame body 13 become first screw holes 13*m* and 13*n* alone, as shown in FIGS. 16 and 19.

However, fixing each holder to the developing frame body 13 by only one screw, as compared with fixing each holder to the developing frame body 13 by two screws, causes a reduction in fastening force relative to the developing frame body 13. Therefore, the supported state of the parts supported by each holder relative to the developing frame body 13 may be weakened to thereby give rise to the following problems.

The supporting of the developing sleeve 12 rotatably supported by the holder 90 through the bearing 92 becomes unstable as compared with a case where the holder 90 is screwed by two screws. That is, with the driving of the developing sleeve 12, the bearing 92 and the holder 90 supporting the developing sleeve 12 cause vibration or positional deviation, and this leads to the deterioration of the image quality.

Also, the supporting of the magnet 17, the first idler gear 93, the second idler gear 94, the toner container agitating gear 95 and the third idler gear 96 supported relative to the developing frame body 13 by the holder 91 becomes unstable and causes vibration, and this leads to the aggravation of the quality of image.

Also, the electrical contact 22 and the developing bias contact 90*a* assembled to the holder 90 are electrically connected to the contact portions 105 and 103, respectively, of the image forming apparatus A shown in FIG. 7. If, however, the fixing of the holder 90 to the developing frame body 13 is unstable, the connected states of the electrical contact 22 and the developing bias contact 90*a* to the contact portions 105 and 103 become unstable due to vibration, positional deviation or the like, and this may cause faulty electrical conduction.

So, in order to solve these problems, it is necessary to effect the fixing of the holder 91 and the holder 90 firmly.

Figure 23:
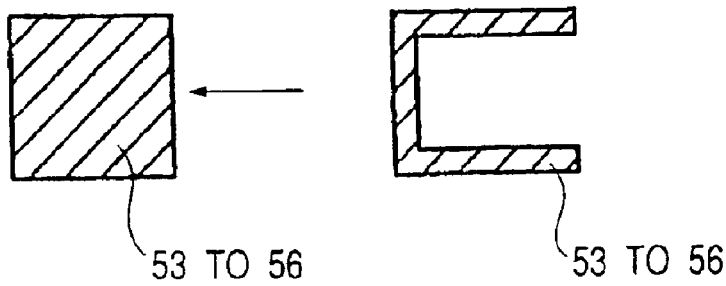
FIG. 23 is a typical view of a coupling member according to the embodiment of the present invention.

So, by one of the following methods, the holder 91 and the holder 90 are fixed to respective fixing portions by the use of coupling fittings 53–56 (the supporting member mounting step: S6 in FIG. 30). The coupling fittings 53–56 are made of such a U-shaped spring material as shown in FIG. 23, and have such predetermined spring pressure as can firmly fix the holders and each portion when they are to be fixed.

(First Fixing Method: Holder 90 and Developing Frame Body 13)

FIG. 16 shows a state in which the holder 90 is mounted on a first screw hole 13*m* of the developing frame body 13 by a screw 90*d*.

A second screw hole 13*k* is formed with the cutting surface 13*k*–1 by the cutting by the cutter, and it is impossible to fix the holder 90 to the developing frame body 13 by the use of the second screw hole 13*k*.

So, the design of the apparatus is made such that the coupling fittings 53 are mounted so as to sandwich the holder 90 and the developing frame body 13 to thereby fix the two firmly.

More particularly, the design of the apparatus is made such that a concave portion 90*g* formed in the outer side of the mounting surface of the electrical contact 22, which is provided on the holder 90, and a mounting portion 13*s* of the developing frame body 13 for the seal member 27 are fixed by the coupling fittings 53 (see FIGS. 4 and 16).

The mounting location for the coupling fittings 53 may be any location at which the holder 90 and the developing frame body 13 can be fixed firmly. That is, the coupling fittings 53 may be mounted at any location except a location which will hinder the insertion thereof into the electrophotographic image forming apparatus A, a location which will hinder the assembling of the unit C, the electrical contact portions, etc.

(Second Fixing Method: Holder 91 and Developing Frame Body 13)

FIG. 19 show a state in which the holder 91 is mounted on the first screw hole 13*n* of the developing frame body 13 by a screw 91*b*.

The second screw hole 13*l* is formed with a cutting surface 13*l*–1 by the cutting by the cutter, and it is impossible to fix the holder 91 to the developing frame body 13 by the use of the second screw hole 13*l*.

Figure 20:
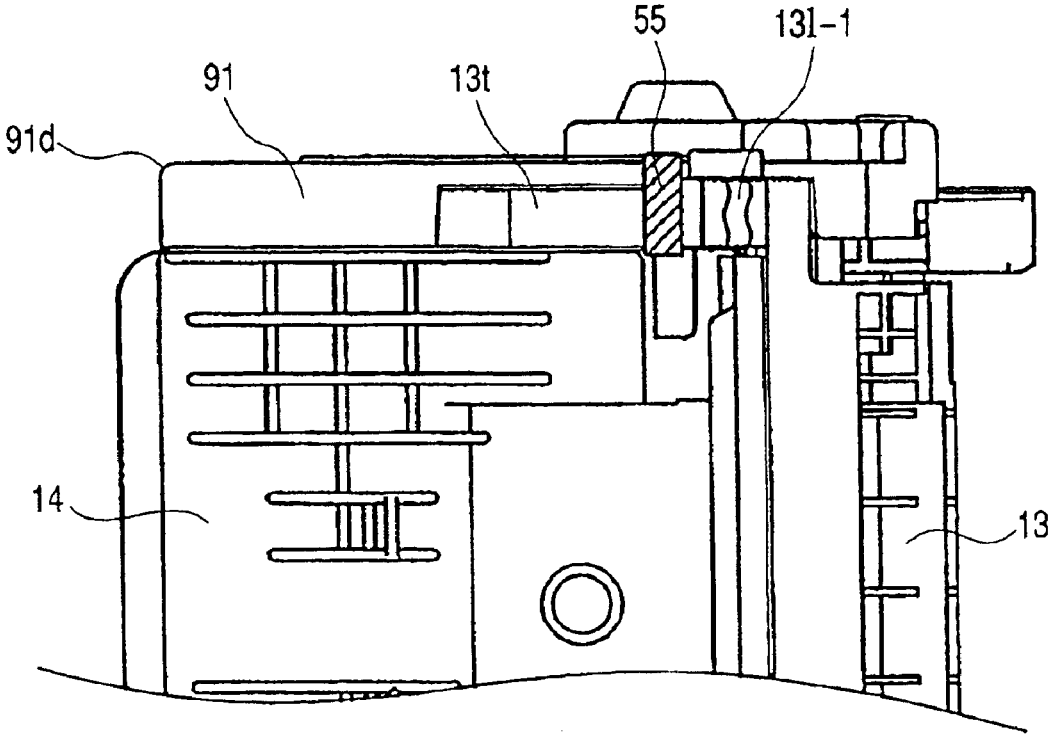
FIG. 20 is an illustration regarding the coupling of the developing frame body and the holder according to the embodiment of the present invention.
Figure 22:
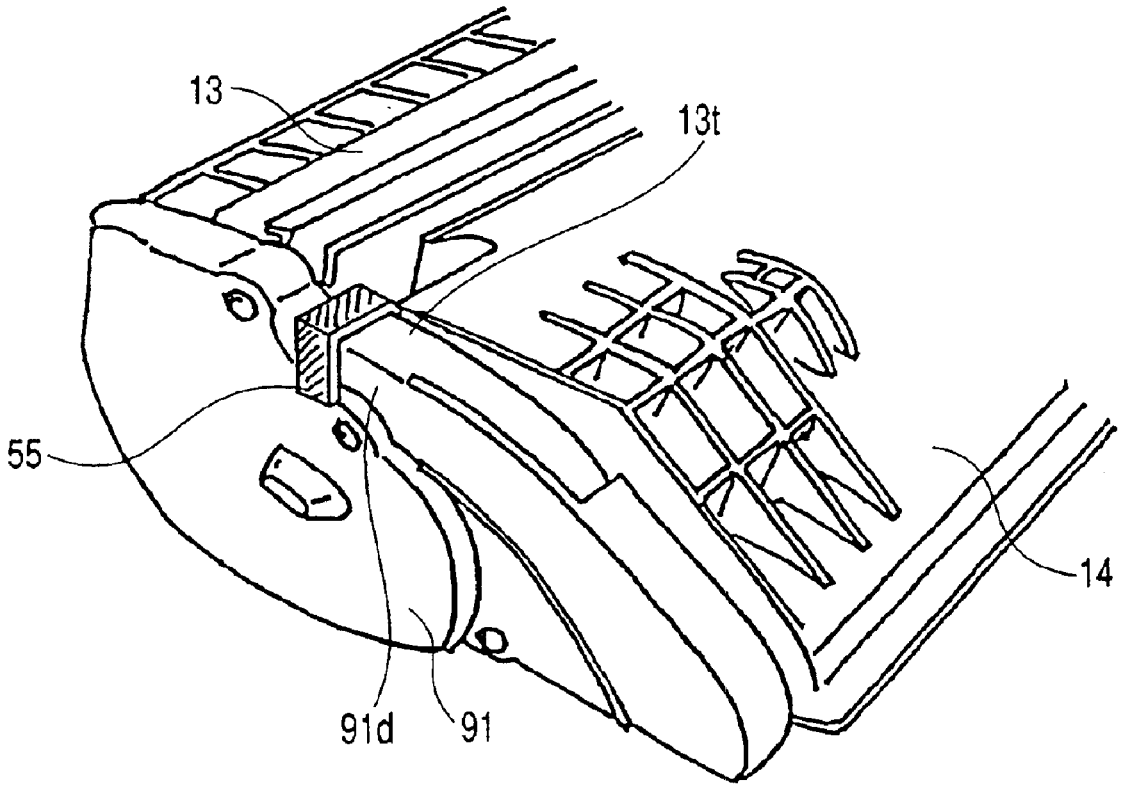
FIG. 22 is an illustration regarding the coupling of the developing frame body and the holder according to the embodiment of the present invention.

So, as shown in FIGS. 20 and 22, the coupling fittings 55 are mounted so as to sandwich the holder 91 and the developing frame body 13 to thereby fix the two (FIG. 20 is a view taken along the direction of arrow A in FIG. 19, and FIG. 22 is a perspective view corresponding to FIG. 20).

More particularly, the design of the apparatus is made such that the outer end surface 91*d* of the holder 91 shown in FIGS. 20 and 22 and the side plate 13*t* of the developing frame body 13 shown in FIG. 25 are fixed by the coupling fittings 55. The side plate 13*t* covers a portion of a toner cap 11 a provided on the toner container 11 shown in FIG. 25.

However, the mounting location for the coupling fittings 55 may be any location at which the holder 91 and the developing frame body 13 can be fixed firmly. That is, the coupling fittings 55 may be mounted at any location except a location which will hinder the insertion thereof into the electrophotographic image forming apparatus A, a location which will hinder the assembling of the unit C, etc.

(Third Fixing Method: Holder 91 and Toner Container 11)

Figure 21:
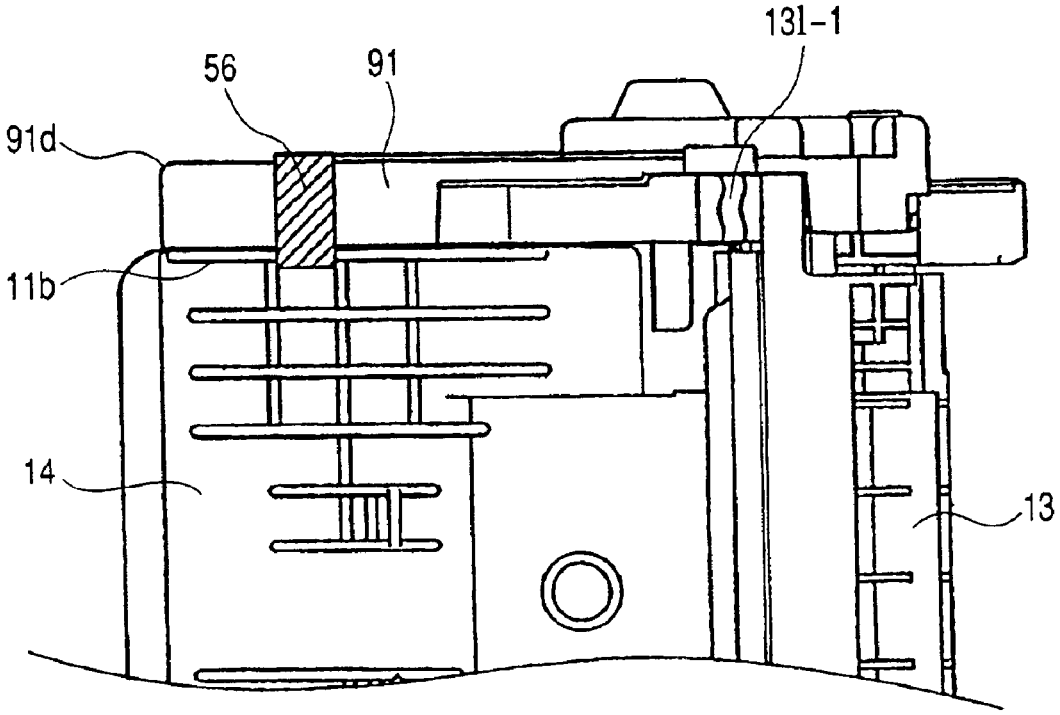
FIG. 21 is an illustration regarding the coupling of the toner container and the holder according to the embodiment of the present invention.
Figure 26:
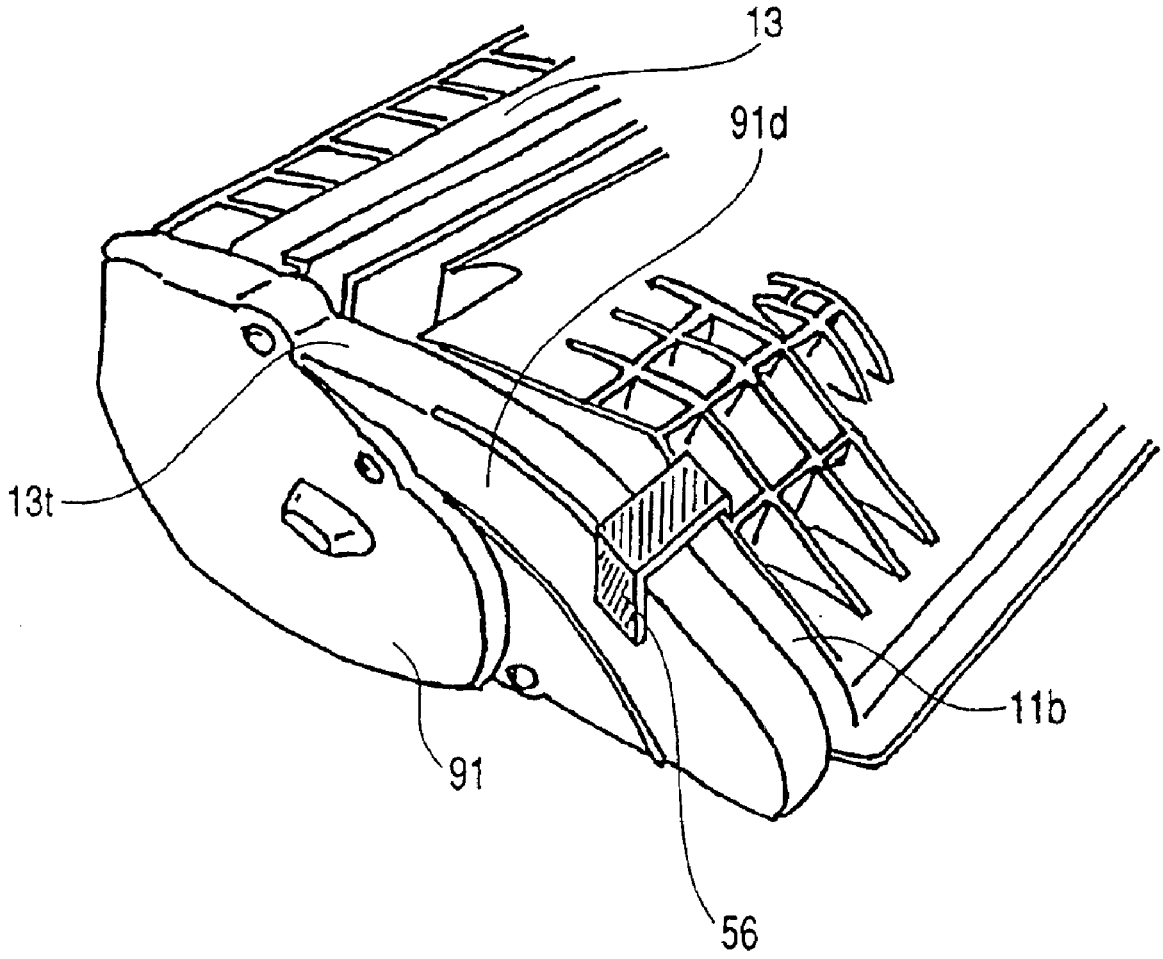
FIG. 26 is an illustration regarding the coupling of the toner container and the holder according to the embodiment of the present invention.

FIGS. 21 and 26 show a state in which the holder 91 is fixed to the toner container 11 by coupling fittings 56 (FIG. 21 is a view taken along the direction of arrow A in FIG. 19, and FIG. 26 is a perspective view corresponding to FIG. 21).

The outer end surface 91 d of the holder 91 and a reinforcing rib 11*b* provided in the toner container 11, which is shown in FIGS. 21 and 26, are fixed by the coupling fittings 56.

(Summary of the Fixing Method)

The fixing method for the holder 91 and the holder 90 can be carried out by suitably combining the methods as described above.

(Assembling of the Process Cartridge)

Next, assembling is effected by a procedure opposite to disassembling. However, the parts of the unit C and the developing unit D are suitably inspected and reusable ones are cleaned and thereafter assembled, and unreusable parts are interchanged with new parts and the assembling thereof is effected. Thereafter, the assembled unit C and developing unit D are coupled together by the coupling pin 40 and are reproduced as a process cartridge.

The above-described embodiment of the present invention can be summarized and supplemented as follows.

The invention relates to a method of reproducing a process cartridge or a developing apparatus. The process cartridge or developing apparatus is provided with:

a toner container 11 containing therein a toner which is a developer;

a developing frame body 13 coupled to the toner container 11; and a holder (at least one of a holder 90 and a holder 91) for holding at least one (e.g. a developing sleeve 12) of the constituent parts of developing means 10 mounted on one end of the developing frame body 13 for developing a latent image on a photosensitive drum 7 functioning as an image bearing member by the use of the toner in the toner container 11. The process cartridge or the developing apparatus is made detachably attachable to an image forming apparatus.

The method comprises the steps of:

removing the holder from the developing frame body 13;

separating the toner container 11 and the developing frame body 13 from each other;

sticking a toner seal member 61 on a toner supplying opening portion provided in that side of the toner container 11 which is adjacent to the developing frame body 13 for closing the toner supply opening portion;

filling (refilling) the toner container 11 with the toner;

coupling the toner container 11 and the developing frame body 13 together; and coupling at least one of the toner container 11 and the developing frame body 13, and the holder together by the use of a coupling member.

The coupling member used to couple at least one of the toner container 11 and the developing frame body 13, and the holder together will be described here.

As described above, the design of the apparatus is made such that the holder is fixed to at least one of the toner container 11 and the developing frame body 13 by the coupling fittings 53–56 to thereby increase the fixing strength of the holder. As a result, the member held by this holder is stably positioned, whereby it is made possible to form an image of high quality.

As the coupling fittings 53–56, there has specifically been shown an example which adopts a sandwiching member for sandwiching two members to be coupled together, by the use of a member having a U-shaped cross section, as shown in FIG. 23.

However, the coupling member is not restricted to such one. That is, any member which can fix the holder to at least one of the toner container 11 and the developing frame body 13 is applicable.

As described above, however, in the present embodiment, the reduction in the fixing force caused by the screwing holes becoming unusable at the step of separating the toner container 11 and the developing frame body 13 from each other is compensated for. Therefore, the fixing force is increased by the coupling member.

A suitable coupling member is one which enables coupling to be accomplished by simple work and which occupies a small space. Accordingly, besides the sandwiching member as described above, an adhesive tape or the like can also be suitably used.

A description will now be provided of a specific example of the holder which becomes the object in the above-described coupling process using the coupling member.

The holder rotatably holds the developing sleeve 12 for carrying the toner to a developing position while carrying thereon the toner in the toner container 11, through the bearing 92. That is, in the above-described example, the holder 90 can be the object of the coupling process using the coupling member.

In this case, the holder 90 is firmly fixed to at least one of the toner container 11 and the developing frame body 13. Therefore, the positional deviation, the vibration or the like of the developing sleeve 12 can be reduced, and this contributes to an improvement in the image quality.

Also, the holder holds the magnet 17 contained in the developing sleeve 12 for carrying the toner to the developing position while carrying thereon the toner in the toner container 11. That is, in the above-described example, the holder 91 can be one of the objects to be coupled by the coupling member.

In this case, the holder 91 is firmly fixed to at least one of the toner container 11 and the developing frame body 13. Therefore, positional deviation, vibration, or the like, of the magnet 17 can be reduced, and this contributes to the improvement in the image quality.

Also, the holder holds drive transmitting gears (the first idler gear 93, the second idler gear 94, the toner container agitating gear 95 and the third idler gear 96) having a gear (the first idler gear 93) for transmitting the driving force from the developing sleeve 12 for carrying the toner to the developing position while carrying thereon the toner in the toner container 11. That is, in the above-described example, the holder 91 can be one of the objects coupled by the coupling member.

In this case, the holder 91 is firmly fixed to at least one of the toner container 11 and the developing frame body 13. Therefore, positional deviation, vibration, or the like, of each drive transmitting gear can be reduced and drive transmission becomes smooth, and this contributes to the improvement in the image quality.

Further, the holder holds the electrical contact portion (electrical contacts 22 and 23) which is an intermediary portion for the exchange of electricity between the image forming apparatus main body side of the apparatus and the process cartridge side of the apparatus. That is, in the above-described example, the bolder 90 can be one of the objects coupled by the coupling member.

In this case, the holder 90 is firmly fixed to at least one of the toner container 11 and the developing frame body 13. Therefore, faulty electrical contact or the like can be prevented, and this contributes to the improvement in the image quality.

As described above, according to the embodiment of the present invention, it is not necessary to adopt a complicated working method in the separating of the developing frame body 13 and the toner container 11. That is, even if cutting and separation are effected by the cutter or the like, there can be reproduced a process cartridge or a developing apparatus which is high in quality. Accordingly, in the work of separating the frame body, any excess number of steps can be curtailed and a simple step suffices.

Also, the holder and the developing frame body 13 or the toner container 11 can be firmly fixed to each other. Therefore, the stability of each member held by the holder increases and a faulty image which may occur from the instability of each member can be prevented.

The steps in the reproducing method of the present invention are not restricted to the aforedescribed order of steps, but may be suitably changed in order.

The present invention also covers any of the following cases.

(1) A case where in reproducing a process cartridge, only the parts removed from the process cartridge are reused to effect the reproduction of the cartridge.

(2) A case where in the aforedescribed case (1), regarding parts which cannot be reused because of having reached the end of their lives or being damaged, the reproduction of a cartridge is effected by the use of new parts or reusable parts removed from other cartridges.

(3) A case where in reproducing a process cartridge, parts removed from a plurality of process cartridges are once gathered by each kind of parts, and necessary parts are selected from among the parts gathered by each kind of parts, and those parts are reused to effect the reproduction of the cartridge.

(4) A case where in the aforedescribed case (3), regarding parts which cannot be reused because of having reached the end of their lives or being damaged, new parts are used to effect the reproduction of the cartridge.

The aforementioned parts are articles constituting the construction described in the appended claims, i.e., constituting some portions of a cartridge. They also cover a minimum unit or a unit which can be disassembled.

As described above, according to the present invention, the reproduction of a process cartridge and a developing apparatus can be effected easily. Also, it has become possible to simply effect the coupling of a toner container and a developing frame body. Further, it has become possible to simply and reliably mount a developing member on the developing apparatus and the process cartridge.

What is claimed is:

1. A method of reproducing a developing apparatus detachably attachable to an electrophotographic image forming apparatus main body, the developing apparatus being designed for developing a latent image formed on an electrophotographic photosensitive member, the developing apparatus having a developing member configured and positioned to develop the latent image formed on the electrophotographic photosensitive member, a developer container having a developer containing part containing therein a developer to be used by the developing member, and provided with a developer supplying opening for supplying the developer contained in the developer containing part to the developing member, a supporting member provided on a lengthwise end portion of the developing apparatus configured and positioned to support the developing member, and a developing frame body provided with a developer passing opening for passing therethrough the developer supplied from the developer supplying opening, and having a joint portion to be joined to the developer container, and a mounting portion configured and positioned to mount the supporting member, said method comprising:

a supporting member removing step of removing the supporting member from the developing frame body;

a developing frame body separating step of separating the developer container and the developing frame body from each other at the joint portion, and at which at least a portion of the mounting portion is removed when the developer container and the developing frame body are separated from each other;

a sticking step of sticking a seal member on the developer supplying opening provided in the developer container separated at said developing frame body separating step to close the developer supplying opening;

a developer refilling step of refilling the developer containing part provided in the developer container separated at said developing frame body separating step with the developer;

a developing frame body coupling step of coupling the developer container and the developing frame body separated at said developing frame body separating step together after said sticking step; and a supporting member attaching step of attaching the supporting member removed at said removing step onto at least one of the developer container and the developing frame body by the use of a coupling member.

2. A method according to claim 1, wherein the developing frame body is joined to the developer container at the joint portion by ultrasonic welding, and at said developing frame body separating step, the developer container and the developing frame body are separated from each other by the use of a cutter.

3. A method according to claim 1, wherein the developing frame body is joined to the developer container at the joint portion by ultrasonic welding, and at said developing frame body separating step, the developer container and the developing frame body are separated from each other by the use of a laser.

4. A method according to claim 1, wherein at said supporting member attaching step, the coupling member is mounted with the supporting member and the developing frame body sandwiched thereby.

5. A method according to claim 1, wherein at said supporting member attaching step, the coupling member is mounted with the supporting member and the developer container sandwiched thereby.

6. A method according to claim 4 or 5, wherein the coupling member is constituted by a U-shaped spring material.

7. A method according to claim 6, wherein the coupling member is constituted by a plate spring material.

8. A method according to claim 1, wherein the mounting portion is a boss having a screw hole for attaching the supporting member by a screw, and at said developing frame body separating step, a portion of the boss is removed.

9. A method according to claim 1, wherein the supporting member has a driving force transmitting device configured and positioned to transmit a driving force to the developing member, and at said supporting member removing step, the supporting member is removed from the developing frame body while holding the driving force transmitting device, and at said supporting member attaching step, the supporting member is attached onto the developing frame body while holding the driving force transmitting device.

10. A method according to claim 1, wherein the supporting member has a developing bias contact configured and positioned to contact the developing member and supply a voltage to the developing member, and at said supporting member removing step, the supporting member is removed from the developing frame body while holding the developing bias contact, and at said supporting member attaching step, the supporting member is attached onto the developing frame body while holding the developing bias contact.

11. A method of reproducing a process cartridge detachably attachable to an electrophotographic image forming apparatus main body, the process cartridge having a developing member configured and positioned to develop a latent image formed on an electrophotographic photosensitive member, a developer container having a developer containing part containing therein a developer to be used by the developing member, and provided with a developer supplying opening for supplying the developer contained in the developer containing part to the developing member, a supporting member provided on a lengthwise end portion of the process cartridge and configured and positioned to support the developing member, and a developing frame body provided with a developer passing opening for passing therethrough the developer supplied from the developer supplying opening, and having a joint portion to be joined to the developer container, and a mounting portion configured and positioned to mount the supporting member, said method comprising:

a supporting member removing step of removing the supporting member from the developing frame body;

a developing frame body separating step of separating the developer container and the developing frame body from each other at the joint portion, and at which at least a portion of the mounting portion is removed when the developer container and the developing frame body are separated from each other;

a sticking step of sticking a seal member on the developer supplying opening provided in the developer container separated at said developing frame body separating step to close the developer supplying opening;

a developer refilling step of refilling the developer containing part provided in the developer container separated at said developing frame body separating step with the developer;

a developing frame body coupling step of coupling the developer container and the developing frame body separated at said developing frame body separating step together after said sticking step; and a supporting member attaching step of attaching the supporting member removed at said removing step onto at least one of the developer container and the developing frame body by the use of a coupling member after said developing frame body coupling step.

12. A method according to claim 11, wherein the developing frame body is joined to the developer container at the joint portion by ultrasonic welding, and at said developing frame body separating step, the developer container and the developing frame body are separated from each other by the use of a cutter.

13. A method according to claim 11, wherein the developing frame body is joined to the developer container at the joint portion by ultrasonic welding, and at said developing frame body separating step, the developer container and the developing frame body are separated from each other by the use of a laser.

14. A method according to claim 11, wherein at said supporting member attaching step, the coupling member is mounted with the supporting member and the developing frame body sandwiched thereby.

15. A method according to claim 11, wherein at said supporting member attaching step, the coupling member is mounted with the supporting member and the developer container sandwiched thereby.

16. A method according to claim 14 or 15, wherein the coupling member is constituted by a U-shaped spring material.

17. A method according to claim 16, wherein the coupling member is constituted by a plate spring material.

18. A method according to claim 11, wherein the mounting portion is a boss having a screw hole for attaching the supporting member by a screw, and at said developing frame body separating step, a portion of the boss is removed.

19. A method according to claim 11, wherein the supporting member has a driving force transmitting device configured and positioned to transmit a driving force to the developing member, and at said supporting member removing step, the supporting member is removed from the developing frame body while holding the driving force transmitting device, and at said supporting member attaching step, the supporting member is attached onto the developing frame body while holding the driving force transmitting device.

20. A method according to claim 11, wherein the supporting member has a developing bias contact configured and positioned to contact the developing member and supplying a voltage to the developing member, and at said supporting member removing step, the supporting member is removed from the developing frame body while holding the developing bias contact, and at said supporting member attaching step, the supporting member is attached onto the developing frame body while holding the developing bias contact.

* * * * *

UNITED STATES PATENT AND TRADEMARK OFFICE

CERTIFICATE OF CORRECTION

PATENT NO. : 6,952,544 B2
APPLICATION NO. : 10/670246
DATED : October 4, 2005
INVENTOR(S) : Kikuchi et al.

It is certified that error appears in the above-identified patent and that said Letters Patent is hereby corrected as shown below:

COLUMN 1
Line 54, “etc.);” should read --etc.),--.

COLUMN 8
Line 17, “one” should read --one is--.
Line 18, “one” should read --one is--.

COLUMN 15
Line 59, “show” should read --shows--.

COLUMN 16
Line 9, “11 a” should read --11a--.
Line 21, “91 d” should read --91d--.

COLUMN 18
Line 9, “bolder 90” should read --holder 90--.
Line 45, “parts,” should read --part,--.
Line 47, “parts,” should read --part,--.

Signed and Sealed this

Eighth Day of August, 2006

JON W. DUDAS
*Director of the United States Patent and Trademark Office*